US008442422B2

(12) United States Patent
Takagi et al.

(10) Patent No.: US 8,442,422 B2
(45) Date of Patent: May 14, 2013

(54) BOOKBINDING METHOD, AND BOOKBINDING UNIT AND IMAGE-FORMING SYSTEM EQUIPPED WITH THE SAME

(75) Inventors: Katsumasa Takagi, Kofu (JP); Hiroyuki Sorita, Chuo (JP); Takehiro Yamakawa, Minamitsuru-gun (JP); Jun Kondou, Minami-Alps (JP); Takeshi Harada, Nakakoma-gun (JP)

(73) Assignee: Nisca Corporation, Minamikoma-gun (JP)

( * ) Notice: Subject to any disclaimer, the term of this patent is extended or adjusted under 35 U.S.C. 154(b) by 768 days.

(21) Appl. No.: 12/147,431

(22) Filed: Jun. 26, 2008

(65) Prior Publication Data

US 2009/0035093 A1 Feb. 5, 2009

(30) Foreign Application Priority Data

Jun. 26, 2007 (JP) ..... 2007-167946

(51) Int. Cl.
*G03G 15/00* (2006.01)
*B42C 11/00* (2006.01)

(52) U.S. Cl.
USPC ..... 399/408; 412/18; 412/19; 412/20; 412/21

(58) Field of Classification Search ..... 412/18, 412/19, 20, 21; 399/408
See application file for complete search history.

(56) References Cited

U.S. PATENT DOCUMENTS

| | | | | |
|---|---|---|---|---|
| 2,200,345 | A * | 5/1940 | Schramm | 412/5 |
| 4,987,267 | A * | 1/1991 | Takaoka et al. | 568/615 |
| 5,314,283 | A * | 5/1994 | Zoltner | 412/34 |
| 6,726,424 | B2 * | 4/2004 | Voss | 412/3 |
| 7,658,585 | B2 * | 2/2010 | Brommer et al. | 412/22 |
| 7,845,890 | B2 * | 12/2010 | Sasamoto et al. | 412/13 |
| 2004/0141830 | A1 * | 7/2004 | Yoshie et al. | 412/1 |

FOREIGN PATENT DOCUMENTS

| | | | |
|---|---|---|---|
| JP | 2005-305821 | A | 11/2005 |
| JP | 2007147815 | A * | 6/2007 |

* cited by examiner

*Primary Examiner* — Daniel J Colilla
*Assistant Examiner* — Allister Primo
(74) *Attorney, Agent, or Firm* — Judge Patent Associates

(57) ABSTRACT

Bookbinding unit that in binding an inner-leave sheet bundle together with a cover enables accurate binding of the cover onto the bundle's spine and meanwhile forms folding scores in the cover flaps. Furnished with: a stacking tray unit; a process path for sequentially transporting bundles from the tray unit into adhesive-application and cover-binding locations; an adhesive application unit, disposed in the adhesive-application location, that applies adhesive to bundles from the tray unit; a cover-supply unit that supplies covers to the cover-binding location; and a cover-binding unit, disposed in the cover-binding location, that binds sheet bundles from the adhesive-application location together with covers. The cover-binding unit has a shoulder-pressing unit that forms spine creases in the spine portion of the covers, and a flap-pressing unit that forms folds in the spine-creased sides of the covers.

17 Claims, 14 Drawing Sheets

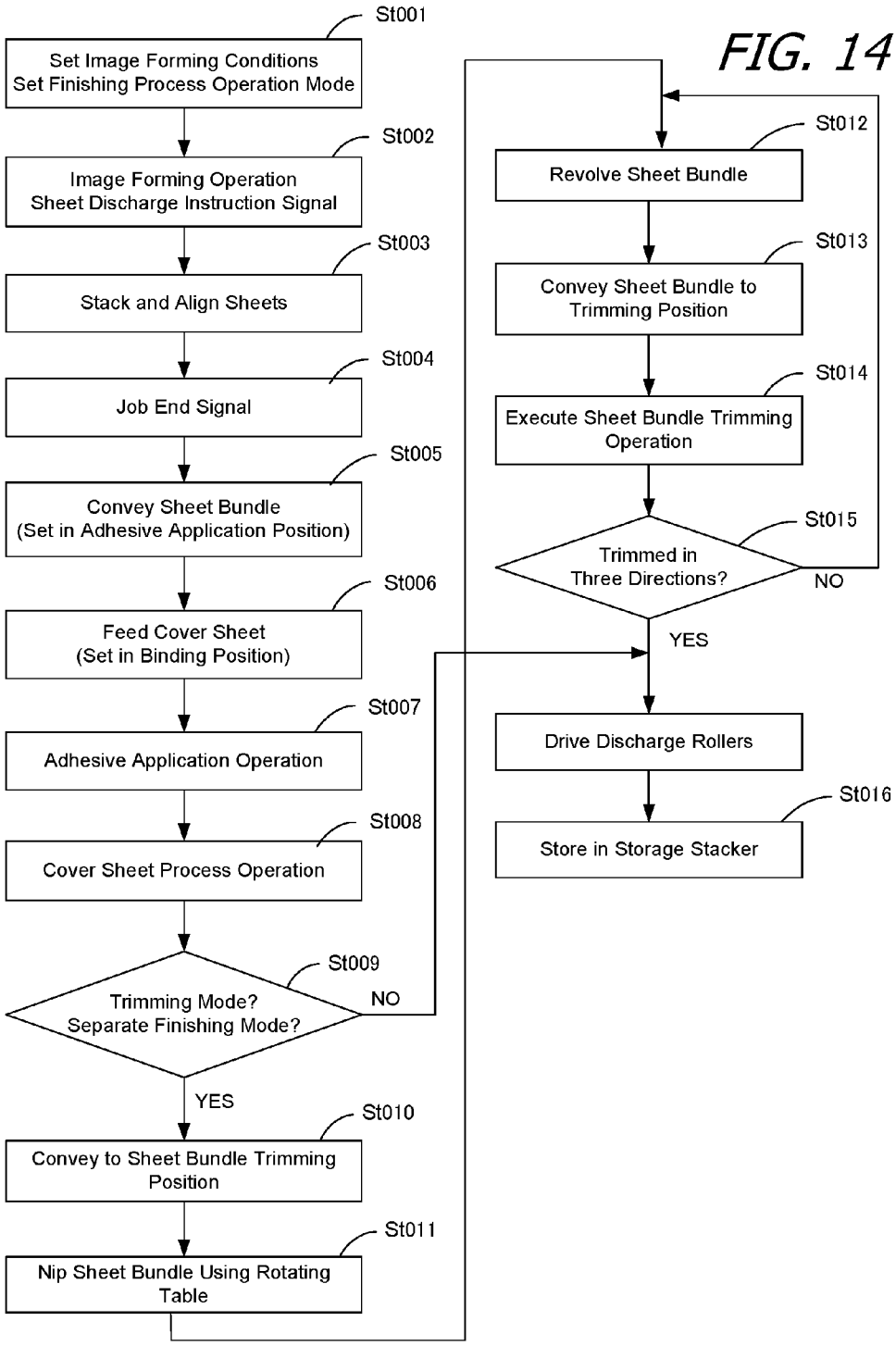
FIG. 14
St001
Set Image Forming Conditions
Set Finishing Process Operation Mode
St002
Image Forming Operation
Sheet Discharge Instruction Signal
St003
Stack and Align Sheets
St004
Job End Signal
St005
Convey Sheet Bundle
(Set in Adhesive Application Position)
St006
Feed Cover Sheet
(Set in Binding Position)
St007
Adhesive Application Operation
St008
Cover Sheet Process Operation
St009
Trimming Mode?
Separate Finishing Mode?
NO
YES
St010
Convey to Sheet Bundle Trimming Position
St011
Nip Sheet Bundle Using Rotating Table
St012
Revolve Sheet Bundle
St013
Convey Sheet Bundle to Trimming Position
St014
Execute Sheet Bundle Trimming Operation
St015
Trimmed in Three Directions?
NO
YES
Drive Discharge Rollers
St016
Store in Storage Stacker

BOOKBINDING METHOD, AND BOOKBINDING UNIT AND IMAGE-FORMING SYSTEM EQUIPPED WITH THE SAME

BACKGROUND OF THE INVENTION

1. Technical Field

The present invention, involving bookbinding units that collate sheets conveyed out of a photocopier, printer, or the like, into a bundle and cover the bundle with a cover sheet, relates to improvements in mechanisms for spine-creasing when encasing a bundle of inner-bound leaves with, and binding the bundle into, a cover sheet.

2. Description of the Related Art

With such bookbinding units generally, so-called perfect binding is known, in which sheets that are conveyed out of an imaging apparatus are stacked and collated into a bundle on a tray device, adhesive is applied to the spine part of the sheet bundle and the bundle is joined together with a cover sheet, into its central portion, in the form of an inverted T, and the cover sheet is spine-creased to close it onto the bundle.

In conventional perfect binding techniques of this sort, forming folding scores in the flaps of the cover sheet is known, and is often adopted with thick cover sheets and other in encasing situations in which the cover cannot be readily folded. Traditionally, however, for such folding scores a cover sheet is pressed, as a process prior to bookbinding, to form the folding scores in the cover.

Meanwhile, various bookbinding units which are linked to the discharge outlet of an imaging apparatus and that collate into bundles sheets on which images have been formed, apply adhesive to the bundle spines, and thereafter bind the bundles together with cover sheets have been proposed—such as is disclosed, for example, in Japanese Unexamined Pat. App. Pub. No. 2005-305822 (cf. FIG. 1). This publication discloses an apparatus that stacks and collates into bundles sheets (inner-bound leaves) from an image forming apparatus and applies adhesive to the spine portion of the bundles with an adhesive applicator disposed downstream; the sheet bundles are case-bound into cover sheets readied at (supplied/fed to) the downstream side of the adhesive applicator. Then, the cover sheets are bound on by contacting, in an inverted-T form, the inner-bound sheet bundle onto the central portion of a cover sheet, and spine-creasing the cover sheet with spine-creasing pressing members. Herein, the spine-creasing pressing members (spine-creasing plates in said publication) are configured to fold over and press the cover sheet with a left/right pair of platelike members.

As described above, in bookbinding by collating into bundles sheets conveyed from an image forming apparatus or the like, and applying adhesive to and thereafter binding covers onto the bundles, conventionally, as is the case with the just-cited JP 2005-305822, the shoulder portions of the cover sheet are fold-bended and press-formed. When pressing members for this purpose, such as spine-folding plates, pressure-nip a cover sheet along both shoulders, the adhesive applied to the spine portion can sometimes leak out onto the back side of the cover sheet (the cover rear face). In particular, if excess adhesive is applied to the spine portion, it can leak out to the cover rear face, giving rise to a defectively bound booklet in which inner-bound leaves are adhered to the back side of the cover sheet. Conversely, if an inadequate amount of adhesive is applied to the spine portion, it can become bent along the spine cover when the cover sheet is opened; either case will lead to problems with the quality of the booklet's appearance.

Along with these sorts of difficulties, if paper of thick caliper is used as a cover sheet, with the cover sheet not bending easily in opening a booklet after it has been bound, areas in the spine cover where the adhesive is weak can become bent. To address this, as described above bookbinding techniques whereby folding scores are formed in both flaps of a cover sheet are known. However, this sort of bookbinding technique cannot easily be adopted in a system apparatus such as in the just-cited JP 2005-305822. In particular, conventional folding scores must be press-formed into the cover sheet in advance, which means that in cases where, for example, in a device system for continuous imaging, both the inner-bound leaves and the cover sheets are printed with images, sent to a bookbinding unit downstream, and bound with covers in the bookbinding unit, processing the cover sheets with folding scores in advance places serious restrictions on the device configuration.

BRIEF SUMMARY OF THE INVENTION

Therein, the present inventors arrived at the concept of, when spine-creasing and molding a cover sheet onto an inner-bound sheet bundle onto which adhesive has been applied, at the same time forming folding scores in both flaps to control leakage of excess adhesive, and the position where the cover sheets are folded.

The present invention provides a bookbinding unit that accurately binds a spine portion to a sheet bundle and forms folding scores in sides of a cover sheet simultaneously when binding inner leaves of the sheet bundle formed with images and a cover sheet.

Still further, the present invention provides an image-forming system with a good bookbinding quality using a simple structure for the cover sheet binding mechanism that collates and stacks sheets conveyed from an image-forming system to a cover sheet.

The present invention employs the following configuration to attain the aforementioned objects.

The system is provided stacking tray means that collates and stacks into a sheet bundle sheets sequentially fed; a bookbinding process path that sequentially conveys the sheet bundle from the stacking tray means to an adhesive application position and a cover-sheet binding location; adhesive application means equipped in the adhesive application position, that applies adhesive to the sheet bundle conveyed from the stacking tray means; cover sheet feeding means that feeds a cover sheet to the cover-sheet binding location; and cover-sheet binding means equipped in the cover-sheet binding location, that binds the sheet bundle conveyed from the adhesive application position and the cover sheet. The cover-sheet binding means has shoulder-portion pressing means that fold the spine to form a shoulder on the cover sheet, and flap-portion pressing means that forms folds in sides of the cover sheet. The shoulder-portion pressing means and the flap-portion pressing means are configured to move as one body to press-form the cover sheet, or to move independently to press-form the cover sheet.

The shoulder-portion pressing means and flap-portion pressing means are set to pressing pressures to form predetermined flap glue portions by using the flap-portion pressing means to control the adhesive that leaks to the shoulders of the cover sheet when folding to form the cover sheet with the shoulder-portion pressing means.

The shoulder-portion pressing means and flap-portion pressing means are composed of the same pressing members. These pressing members have a shoulder-portion forming unit that folds the spine of the cover sheet and a flap-portion forming unit that folds grooves into the sides of the cover sheet. The shoulder-portion forming unit is composed to forcibly press the shoulders of the cover sheet with the folding scores formed by the flap-portion forming unit.

In this configuration, the shoulder-portion pressing means and the flap-portion pressing means are composed of a pair of shoulder-portion pressing members and flap-portion pressing members; these are controlled to (1) press and fold the cover sheet simultaneously, (2) the flap-portion pressing members to form the crease in the sides after the shoulder-portion pressing members fold the cover sheet, or (3) the shoulder-portion pressing members form a shoulder after the flap-portion pressing members fold the spine of the cover sheet.

Gripping conveyance means are equipped in the bookbinding path to convey a sheet bundle from the stacking tray means to the cover-sheet binding location. Cover-sheet binding means binds the sheet bundle gripped by the gripping conveyance means to the cover sheet at the cover-sheet binding location.

The cover-sheet binding means is composed of shoulder-portion pressing means, flap-portion pressing means and spine portion pressing means that touches and supports the spine portion of the cover sheet. This spine portion pressing means supports the cover sheet fed to the cover-sheet binding location. After the shoulder-portion pressing means folds the cover sheet supported by the spine portion pressing means, folding scores are formed in the cover sheet using the flap-portion pressing members.

The system is provided a sheet conveyance path that conveys-in a sheet from an image forming apparatus; stacking tray means that collates and stacks into a sheet bundle sheets conveyed from the conveyance path; a bookbinding process path that sequentially conveys the sheet bundle from the stacking tray means to an adhesive application position and a cover-sheet binding location; adhesive application means equipped in the adhesive application position, that applies adhesive to the sheet bundle conveyed from the stacking tray means; a cover sheet feeding path that feeds the cover sheet from the sheet conveyance path to the cover-sheet binding location; and cover-sheet binding means disposed in the cover-sheet binding location, that binds the sheet bundle conveyed from the adhesive application position and the cover sheet. The cover-sheet binding means has shoulder-portion pressing means that fold the spine of the cover sheet to form a shoulder, and flap-portion pressing means that form folding scores in sides of the cover sheet. The shoulder-portion pressing means and the flap-portion pressing means are configured to integratingly move toward the cover sheet, or to move independently to press and fold the cover sheet.

Also, the image-forming system according to the present invention is composed of an image-forming apparatus that sequentially forms images on sheets, and a bookbinding apparatus that collates into sheet bundles sheets conveyed from the image-forming apparatus and binds them to a cover sheet; the bookbinding apparatus is composed as described above.

The present invention produces the following effects when binding inner leaves of the sheet bundle applied with adhesive to a cover sheet because the spine is folded and formed using shoulder-portion pressing means that fold shoulders of the cover sheet and flap-portion pressing means that form grooves in the sides of the cover sheet.

The flap-portion pressing means (members) prevent leakage of adhesive to the inner sides of the cover sheet (the backside of the cover sheet) so the spine portion of the cover sheet is bound more precisely and does not cause a poor binding of the booklet.

Also, because grooves are formed in the front and back covers of the booklet after the bookbinding process, it is possible to fold the predetermined sides even if the cover sheet is a thick sheet. This prevents damage of the spine portion of the cover sheet when the cover is opened.

Still further, the shoulder-portion pressing members and flap-portion pressing members can be integrated pairs of pressing members on the left and right sides, for example and that structure is simple and does not increase the size of the apparatus. Also, the shoulder-portion pressing members and flap-portion pressing members are separate bodies. By properly varying the timing to fold the cover sheet it is possible to ensure the effects of the invention to prevent the leakage of adhesive and to properly form grooves in the sides of the cover sheet.

BRIEF DESCRIPTION OF THE SEVERAL VIEWS OF THE DRAWINGS

FIG. 3A shows an overall configuration of an adhesive container; FIG. 3B is an explanatory view of the application of adhesive.

FIG. 6A shows pressing members at an idling position; FIG. 6B shows the start of the binding operation.

FIG. 7A shows pressing members forming folding scores in the cover sheet; FIG. 7B shows the completion of the cover sheet binding operation.

FIG. 8A shows an overall perspective view and the folding grooves; FIG. 8B is a sectional view of the configuration of the glued portion.

FIG. 11A shows spine pressing members folding the cover sheet over the inner leaves of the sheet bundle; FIG. 11B shows side pressing members the impressing folding grooves in the sides of the cover sheet.

FIG. 12A shows side pressing members folding the cover sheet over the inner leaves of the sheet bundle; FIG. 12B shows side pressing members the pressing the spine portion.

FIG. 14 is a flowchart of the bookbinding operation in the apparatus shown in FIG. 2.

DETAILED DESCRIPTION OF THE INVENTION

Figure 1:
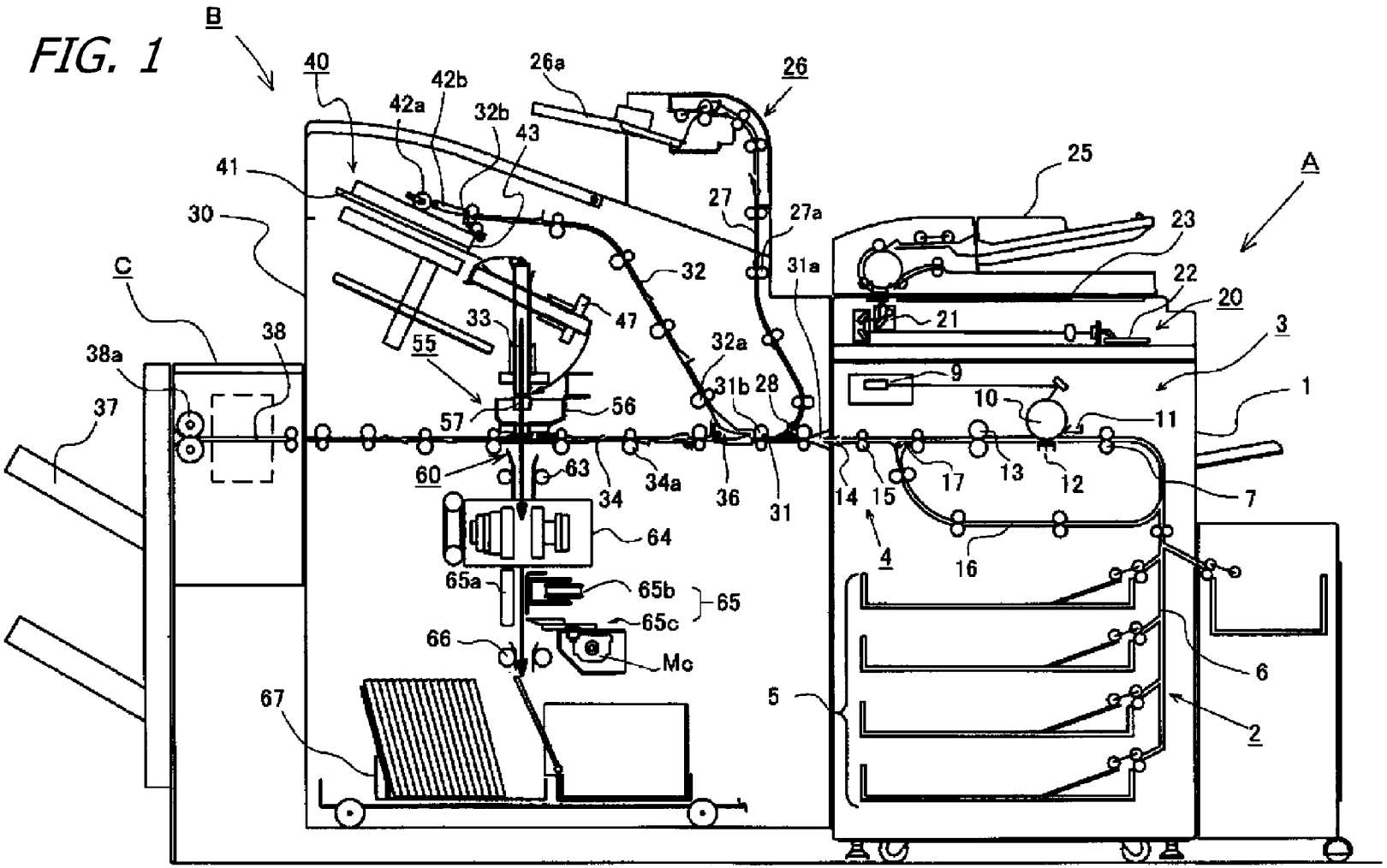
FIG. 1 is an explanatory view of an overall configuration of a bookbinding unit of the present invention and an image-forming system equipped with the same.
Figure 2:
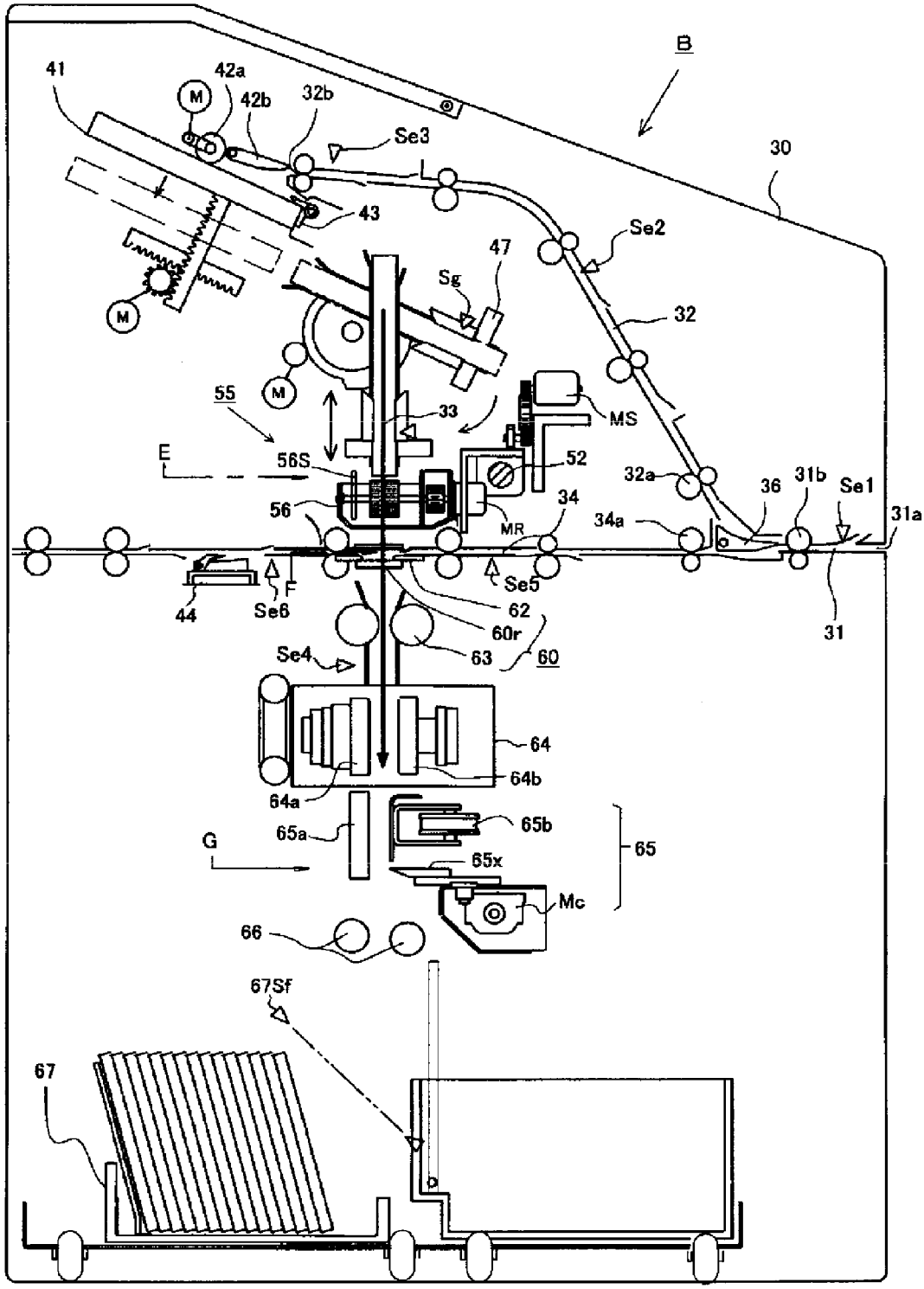
FIG. 2 is a detailed view of the bookbinding unit shown in FIG. 1.

A preferred embodiment of the present invention will now be explained based on the drawings provided. FIG. 1 is an explanatory view of the bookbinding unit according to the present invention and the overall configuration of the image-forming system that uses the bookbinding unit; FIG. 2 is a detailed explanatory view of the bookbinding unit.

Configuration of the Image-forming Apparatus

First, the image-forming unit A can adopt a variety of structures of a copier, printer or printing machine. The drawing shows an electrostatic printing system. A sheet feeder 2, a printing unit 3, a discharge unit 4 and a control unit are installed inside the casing 1 on the image-forming apparatus A. A plurality of cassettes 5 that correspond to sheet sizes is prepared at the sheet feeder 2. Sheet sizes specified by the control unit are fed to the sheet feeding path 6. A registration roller 7 is equipped at the sheet feed path 6. After the leading edge of the sheet is registered by this roller, it is fed at a predetermined timing to the downstream printing unit.

A static electric drum 10 is equipped at the printing unit 3. A print head 9, a developer 11 and a transfer charger 12 are disposed around this drum 10. The print head 9 is composed of a laser emitter, for example, to form electrostatic latent images on the electrostatic drum 10. Toner ink adheres to the latent image at the developer 11, and this is transferred and printed on the sheet at the transfer charger 12. The printed sheet is the fixed at the fixer 13 and discharged to the discharge path 17. A discharge outlet 14 formed in the casing 1 and a discharge roller 15 are disposed at the discharge unit 4. Note that the symbol 16 in the drawing represents a recirculation path. A printed sheet from the discharge path 17 is turned over from front to back at the switchback path and fed to the registration roller 7 to be formed with images on its backside. In this way, a sheet formed with images on one side or both sides is conveyed from the discharge outlet 14 by the discharge roller 15.

Note that the symbol 20 in the drawings is a scanner unit. This optically reads images on an original to printed using the print head 9. As is generally known in the art, the scanner is composed of a platen 23 where an original sheet is set; a carriage 21 that scans the original image along the platen 23; and an optical reading means (for example, a CCD device) 22 that photo-electrically converts optical images received from the carriage 21. The drawing shows an original feeding apparatus 25 that automatically feeds the original sheet to the platen, installed over the platen 23.

Bookbinding Unit Configuration

The following will now explain the bookbinding unit B that is attached to the image-forming apparatus A. The bookbinding unit B is composed of a stacker 40 that stacks and aligns printed sheets into bundles; an adhesive applicator means 55 that applies adhesive to the sheet bundle conveyed from the stacker 40; and cover-sheet binding means 60 that binds the cover sheet to the sheet bundle applied with adhesive, in the casing 30.

Conveyance Path Configuration

A conveyance path 31 having a conveyance inlet 31*a* linked to the discharge outlet 14 of the image-forming unit A is provided in the casing 30, and the intermediate sheet conveyance path 32 and cover sheet conveyance path 34 are linked from this conveyance path 31 via the path switching flapper 36. The bookbinding path 33 is linked to the cover sheet conveyance path 34 via the stacker 40, and a finishing path 38 is connected to the cover sheet conveyance path 34. The bookbinding path 33 is disposed to traverse the apparatus longitudinally in a substantially vertical direction, and the cover sheet conveyance path 34 is disposed in a direction to traverse the apparatus in a horizontal direction.

The bookbinding path 33 and the cover sheet conveyance path 34 mutually intersect (orthogonally); the cover-sheet binding means 60, described below, is disposed in the intersection. The conveyance path 31 configured as described above is linked to the discharge outlet 14 of the image-forming unit A to receive printed sheets from the image-forming unit A. Sheets printed with content information (the leaves of sheets) and sheets printed with a title and the like to be used as a cover sheet (hereinafter referred to as a cover sheet) are conveyed out from the image-forming apparatus A. This conveyance path 31 is branched into the intermediate sheet conveyance path 32 and the cover sheet conveyance path 34, and sort printed sheets to convey them into each path by the use of a path switching flapper 36.

An inserter unit 26 is connected to the conveyance in path 31. This is configured to separate one cover sheet at a time that will not be printed at the image-forming apparatus A from feeder tray 26*a* and feed it to the conveyance in path 31. The inserter unit 26 is equipped with one or a plurality of feeder trays 26*a*. Feeding means that separates stacked sheets into single sheets, and sheet feeding path 27 downstream of the feeding means are disposed on the leading edge of the tray. The sheet feeding path 27 is connected to the conveyance in path 31 interposed by a path switching piece 28. The conveyance roller 31*b* is disposed in the convey-in path 31; the conveyance roller 32*a* is disposed in the inner-sheet conveyance path 32; the gripping conveyance means 47, the sheet bundle posture changing means 64, and the discharge roller 66 (discharge means) are disposed in the bookbinding path 33.

A conveyance roller 34*a* is disposed in the cover sheet conveyance path 34 and a conveyance roller 38*a* is disposed in a finishing path 38; each of these is connected to a drive motor. Note that 34*g* shown in FIG. 5 denotes a movable guide of the cover sheet conveyance path 34. A pair of these is disposed left and right of the cover-sheet binding location F, described below, to guide the upstream and downstream sides of the cover sheet conveyed to the cover-sheet binding location F. This pair of movable guides 34*g* is linked to a drive motor, not shown, to retreat (when binding the cover sheet) upward from the cover-sheet binding location F.

Stacker Configuration

The stacking tray 41 arranged at the discharge outlet 32*b* of the inner sheet conveyance path 32 stacks and stores sheets from the discharge outlet 32*b* in a bundle. As shown in FIG. 2, the stacking tray 44 is composed of a tray member disposed in substantially horizontal posture; a forward and reverse rotating roller 42*a* and conveyance guide 42*b* are furnished thereabove. Also, printed sheets from the discharge outlet 32*b* are guided to the stacking tray 41 by the conveyance guide 42*b* and are stored by the forward and reverse rotating roller 42*a*. The forward and reverse rotating roller 42*a* feeds the printed sheet to the leading edge of the stacking tray 41 with a forward rotation. When rotated in reverse, the trailing edge of the sheet is pushed against an aligning member 43 disposed at the trailing edge of the tray (the right edge of FIG. 2) to become aligned. A sheet side aligning means, not shown, is equipped on the stacking tray 41 to align both edges of the printed sheet stored in the tray to reference positions. With this configuration, printed sheets conveyed from the inner-sheet conveyance path 32 are sequentially stacked in the stacking tray 41 and aligned into a bundle shape.

Configuration of the Sheet Bundle Conveyance Means

Gripping conveyance means 47 are furnished in the bookbinding path 33 to convey a sheet from the stacking tray 41 to a downstream adhesive application position F. As shown in FIG. 2, the gripping conveyance means 47 turns the sheet bundle stacked on the stacking tray 41 from a horizontal posture to a vertical posture, then conveys the sheet bundle to the adhesive application position F by conveying it along the bookbinding path 33 disposed in a substantially vertical direction. For that reason, the stacking tray 41 moves from a stacking position (solid lines in FIG. 2) to the hand-over position (dashed line in FIG. 2), and hands over the sheet bundle to the gripping conveyance means 47 prepared at this hand-over position.

Adhesive Application Unit Configuration

Figure 3A:
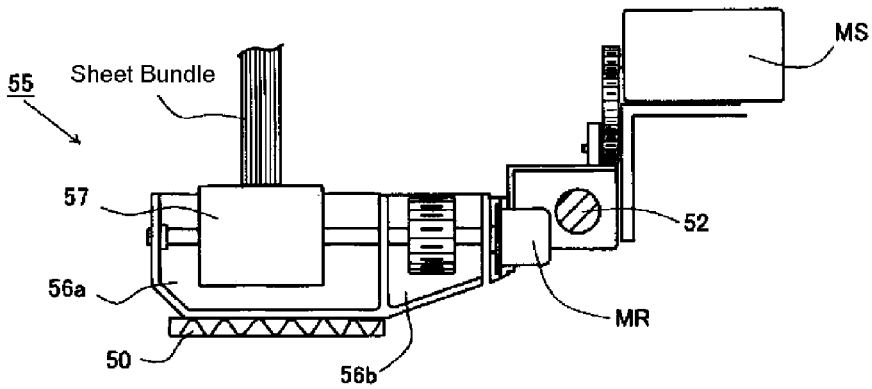
FIGS. 3A and 3B show an adhesive application means in the apparatus shown in FIG. 2.

An adhesive application means 55 is disposed in the adhesive application position E of the bookbinding path 33. As shown in FIG. 3A the adhesive application means 55 is composed of an adhesive container 56 that stores hot-melt adhesive; an applicator roller 57; and a roller rotating motor MR. The adhesive container 56 is separated into a liquid-form adhesive storage compartment (hereinafter referred to as the liquid adhesive storage compartment) 56*a* and a solid-form adhesive storage container (hereinafter referred to as the solid adhesive storage compartment) 56*b*; an applicator roller 57 is rotatably installed in the liquid adhesive storage compartment 56*a*. An adhesive sensor 56S that detects the remaining amount of adhesive is disposed in the liquid adhesive storage compartment 56*a*. The adhesive sensor 56*c* also duals as an adhesive temperature sensor. At the same time that this sensor detects the temperature of the liquefied adhesive in the liquid adhesive storage compartment 56*a*, it also detects the amount of adhesive remaining in the container according to the difference in temperature of the portion dipped in the adhesive. Also, heating means 50, such as an electric heater or the like, is embedded in the adhesive container 56. This adhesive sensor 56S and heating means 50 are connected to a control CPU 75, described below, to adjust the temperature of the adhesive in the liquid adhesive storage compartment 56*a* to a predetermined temperature for liquefaction in the compartment. The applicator roll 57 is composed of a porous and heat resistant material and is configured to be impregnated with adhesive and to enable adhesive to form a layer on the circumference of the applicator roller.

Figure 3B:
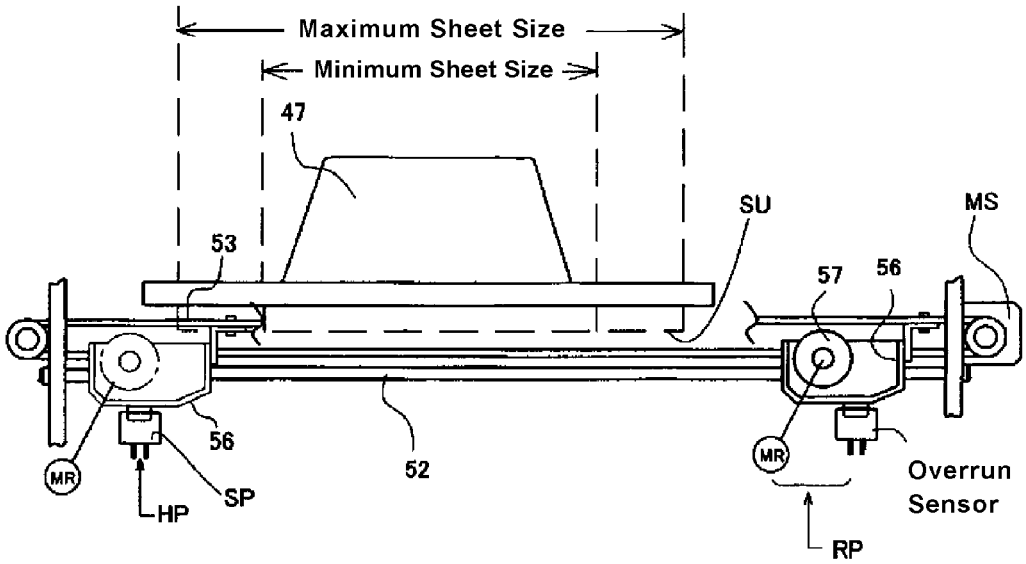

The adhesive container 56 as described above has a reciprocating motion along the sheet bundle. FIG. 3B is a conceptual view of the container. The adhesive container 56 is formed to a shorter length (dimension) than the bottom edge of the sheet bundle (the backside covered at the binding process) SU. The container is supported on a guide rail 52 of the apparatus frame to move along the bottom edge SU of the sheet bundle along with the applicator roller 57 installed in that container. The adhesive container 56 is connected to a timing belt 53 installed on the apparatus frame; a drive motor MS is connected to the timing belt 53.

Therefore, drive motor MS reciprocates the adhesive container 56 between a home position HP and a return position RP where the return operation is started along the sheet bundle. Each position is set to the positional relationships shown in FIG. 3B; the return position RP is set based on sheet width size information. The adhesive container 50 is set to the home position HP when the power is turned on (at device initialization). For example, this moves from the home position HP to the return position RP after a predetermined amount of time after a sheet grip signal from the grip sensor Sg of the gripping conveyance means 47. At the same time as this movement, the roller rotating motor MR starts rotating the applicator roller 57. Note that the home position sensor of the adhesive container 56 is given the symbol SP in the drawing. With the adhesive applicator means 55 configured as described above, rotation of the drive motor MS starts moving the adhesive container 56 from the left side of FIG. 3B to the right side along the guide rail 52. The amount of travel of the gripping conveyance means 47 is adjusted by the elevator motor (not shown) so that the applicator roller 57 pressingly contacts the sheet bundle to slightly separate the edges of the sheets in the advancing path, and forms a predetermined gap with the sheet bundle edge in the return path to return from the return position RP to the home position HP to apply adhesive.

Configuration of the Cover-Sheet Binding Means

Figure 5:
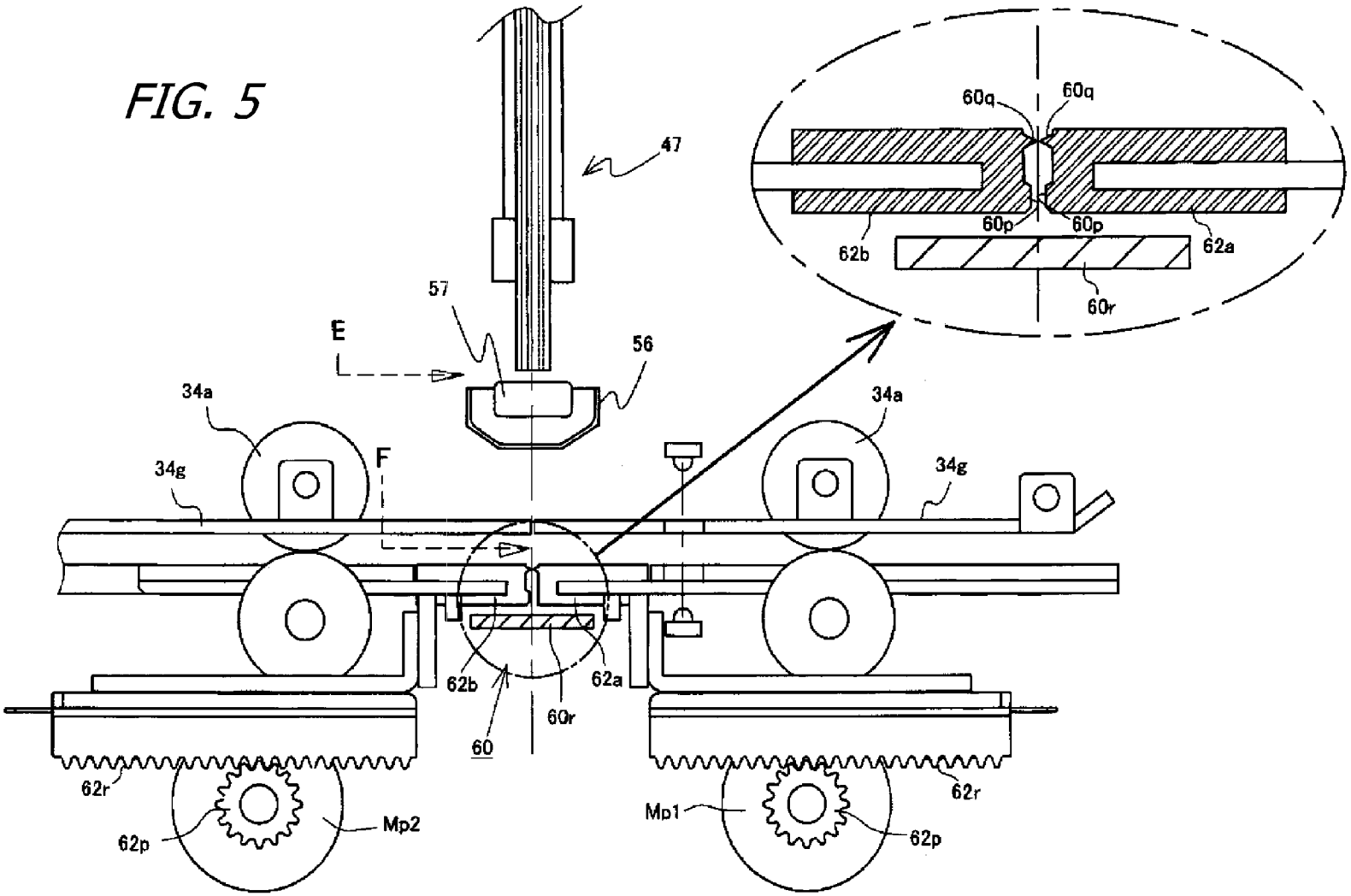
FIG. 5 is a view of a first embodiment of a cover-sheet binding means in the apparatus shown in FIG. 2, and an expanded view of the essential parts.
Figure 6A:
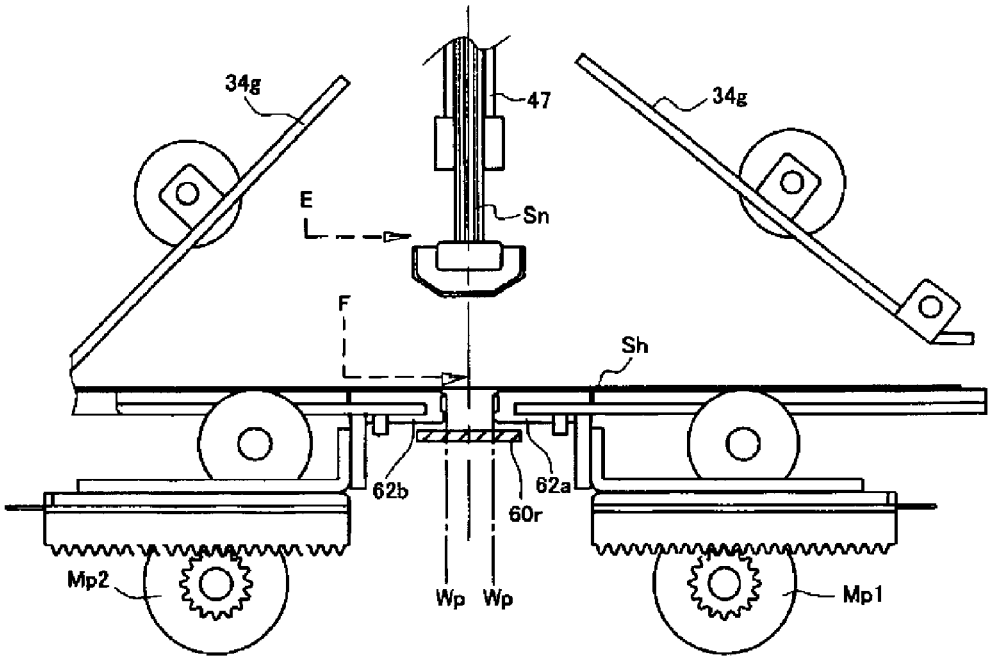
FIGS. 6A and 6B are explanatory views of the operation of the apparatus shown in FIG. 5.
Figure 10:
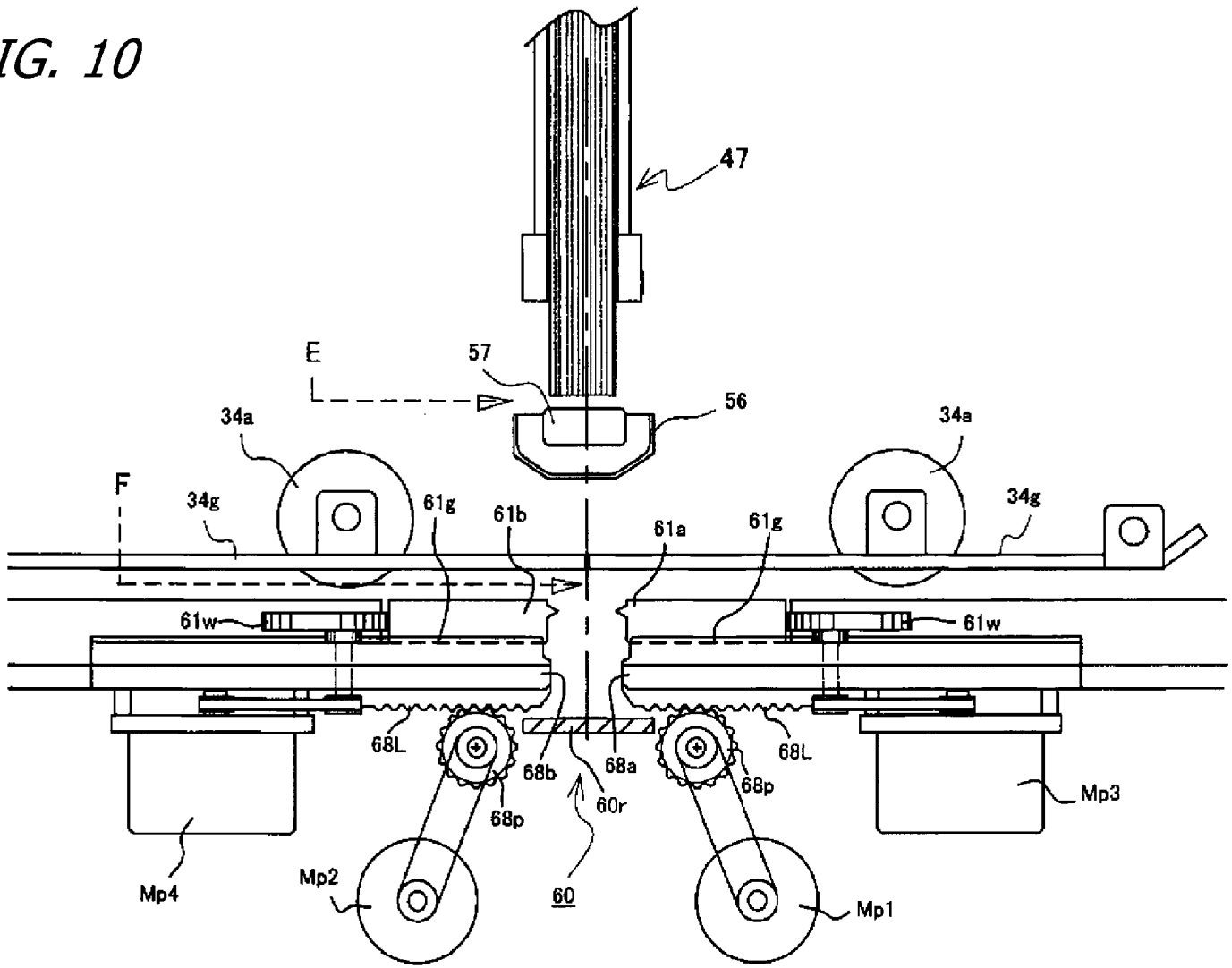
FIG. 10 is a view of a second embodiment of a cover-sheet binding means in the apparatus shown in FIG. 2.

The cover-sheet binding means 60 is disposed in the cover-sheet binding location F of the bookbinding path 33. The cover-sheet binding means 60 is composed of a shoulder-portion pressing means 60*p*, flap-portion pressing means 60*q*, and spine portion pressing means 60*r*. These fold the cover sheet abutted into alignment in an upside-down T shape at the cover-sheet binding location F over the inner leaves of sheets in the sheet bundle. This shoulder-portion pressing means (pressing members) 60*p* is disposed to fold the shoulders connected to the spine binding of the cover sheet; the flap-portion pressing means (pressing members) 60*q* is disposed to form folding grooves in the sides separated a distance from the cover sheet shoulder portions. The shoulder-portion pressing means 60*p* and flap-portion pressing means 60*q* are either 1) composed of integrated members to pressingly move simultaneously, or 2) of separate members to pressingly move independently. FIG. 5 is an explanatory view showing an embodiment of 1) the integrated configuration; FIGS. 6A and 7B are explanatory views shown its operation. FIG. 10 is an explanatory view showing an embodiment of 2) the separated configuration; FIGS. 11A, 11B, 12A and 12B are explanatory views shown its operation. Each will be explained below.

First Embodiment of Cover-Sheet Binding Means (See FIG. 5.) As shown in FIG. 5, the cover-sheet binding means 60 is disposed in the cover-sheet binding location F disposed downstream of the adhesive application position E. The cover-sheet binding means 60 is composed of a first pressing member 62*a* and a second pressing member 62*b* (collectively called pressing members 62); the pressing members 62 compose the shoulder pressing means 60*p* and the side pressing means 60*q*. The pressing members 62 are supported on guide rails (not shown) on the apparatus frame to be opposing on the left and right of the cover-sheet binding means 60. They are supported to approach and separate from each other between an idling position Wp and an operating position Ap. A control motor Mp1 is connected to the first pressing member 62*a*; a control motor Mp2 is connected to the second pressing member 62*b*. Specifically, rack gears 62*r* are integrally formed on the pressing members 62, and drive pinions 62*p* linked to the control motors Mp1 and Mp2 mesh with the rack gears 62*r*. The reason for configuring the pressing members 62 to be driving individually using the control motor Mp1 and Mp2 is to vary the operating strokes of the first pressing member 62*a* and second pressing member 62*b*. Therefore, if both members have the same operating strokes, it is acceptable to drive the pressing members 62 using a single control motor.

Both pressing members 62 are equipped with shoulder portion pressing projections (the shoulder-portion pressing means; hereinafter this is the same) 60*p* and side portion pressing projections (hereinafter referred to as flap-portion pressing means) 60*q*. Shoulder portion pressing projections 60*p* are disposed in positions shown in the drawing adjacent to the cover-sheet binding location F and are formed to flat-face-shaped projections so that they do not damage the cover sheet. The side portion pressing projections 60*q* are formed to sharp projections to press in a folded groove (see gL shown in FIG. 8A) in the cover sheet Sh. As shown in FIG. 5, the side portion pressing projections 60*q* are formed to forcefully press the cover sheet Sh projecting further outward than the shoulder portion pressing projections 60*p*.

Spine pressing means 60*r* is disposed downstream of the pressing members 62. The spine portion pressing means 60*r* is configured to project into and out of the bookbinding path 33, and is composed of a plate-shaped member that supports the cover sheet Sh when pushing the inner leaves of sheets in the sheet bundle Sn to the cover sheet Sh. The pressing members 62 press with the spine portion of the cover sheet touching the spine portion pressing means 60*p*. Also the spine portion pressing means 60*r* supports the spine portion of the cover sheet when the spine is being pressed and has a cooling effect on the adhesive thereby hardening it at the same time as supporting the cover sheet so that it does not become wrinkled or uneven.

The following will now explain the cover sheet Sh binding operations in the first embodiment of the cover-sheet binding means 60. First, FIG. 5 shows adhesive being applied to the inner leaves of the sheet bundle Sn. Both the shoulder-portion pressing means 60*p* and flap-portion pressing means 60*q* are retreated to their retreated positions. Also, the spine portion pressing means 60*r* is retreated from the bookbinding path 33. In this state, when adhesive is applied to the inner leaves of the sheet bundle Sn, the gripping conveyance means 47 conveys the inner leaves of the sheet bundle to the downstream cover-sheet binding location F. At that time, the cover sheet Sh is fed from the cover sheet conveyance path 34 and set at the cover-sheet binding location F. The spine portion pressing means 60*r* also moves to and is set at the cover-sheet binding location F in the bookbinding path. The first pressing member 62*a* on the right side of the drawing moves to a position corresponding to the thickness of the inner leaves of sheet bundle Sn and idles there. A sheet bundle detection sensor (not shown) is provided for the movement to the idling position Wp to detect the thickness of the sheet bundle set on the stacking tray 41 and is configured to detect the thickness of the inner leaves of the sheet bundle Sn that have been pre-aligned. The first pressing member 62*a* idles at the position corresponding to the bundle thickness based on the bundle thickness information obtained from this detection sensor. With the movement to the idling positions Wp, attention was paid to the first pressing member 62*a* and the second pressing member 62*b* folding the cover sheet Sh at the same time on the left and right sides. This state is shown in FIG. 6A.

Figure 6B:
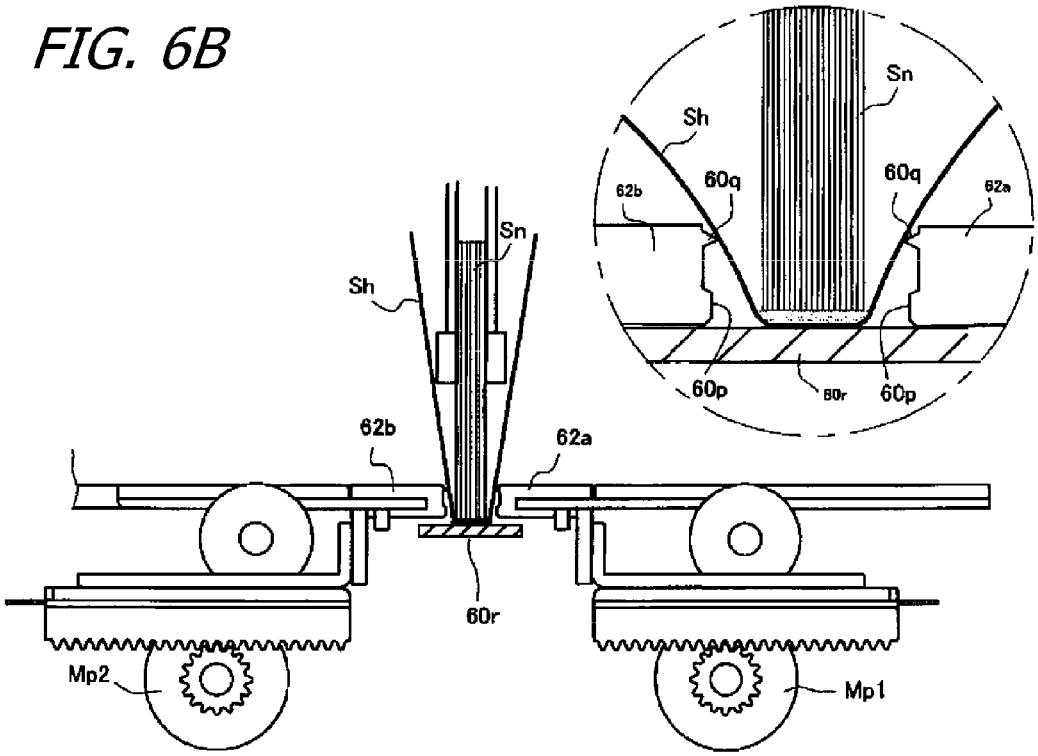

Next, the control means (cover-sheet binding means control unit) 75*c*, described below, controls the drive of the control motors Mp1 and Mp2. With that, the pressing members 62 start bending the shoulder portions of the cover sheet Sh, as shown in FIG. 6B. The movement of the pressing members toward the binding direction gradually causes the cover sheet Sh to be folded.

Figure 7A:
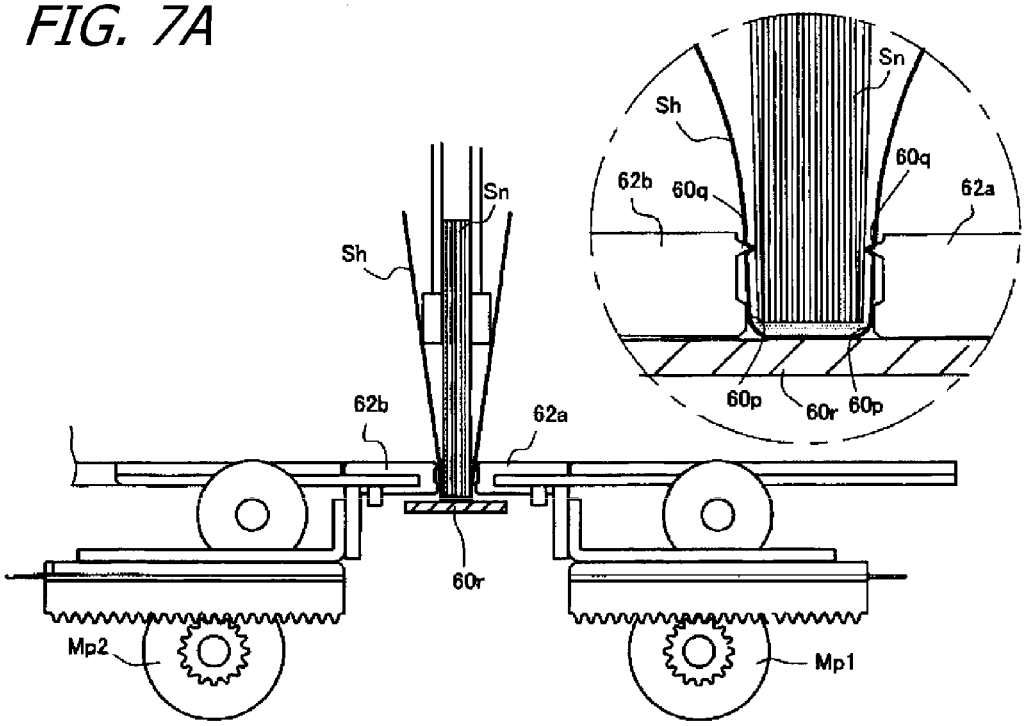
FIGS. 7A and 7B are explanatory views of the operation of the apparatus shown in FIG. 5.
Figure 7B:
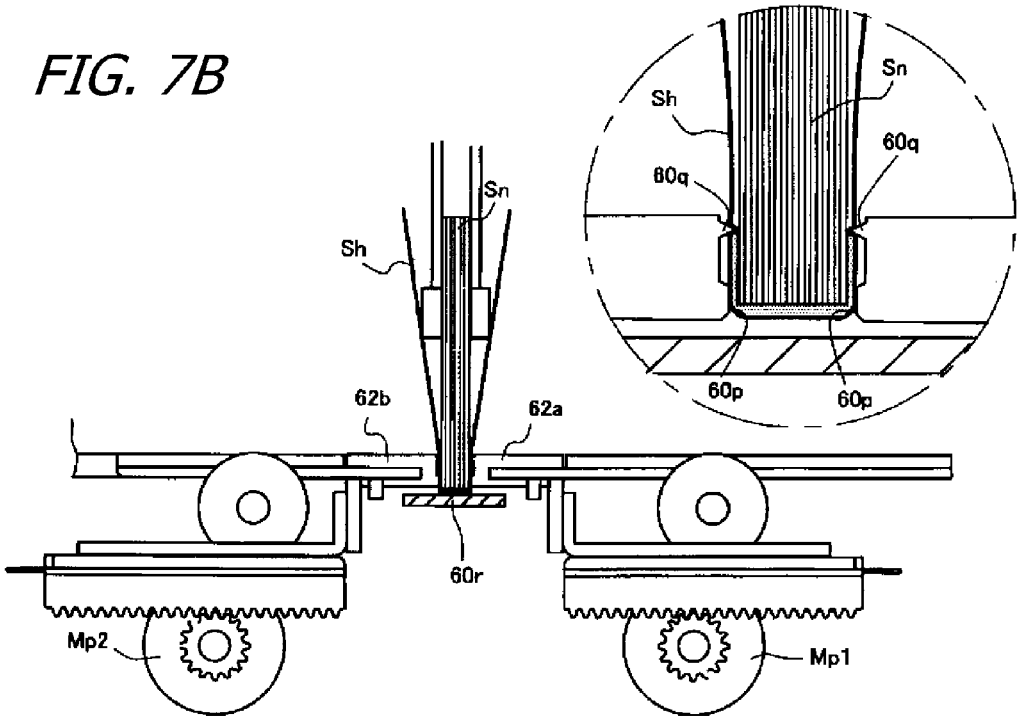

When the cover sheet Sh is folded over the inner leaves of the sheet bundle Sn, as illustrated in FIG. 7A, the side portion pressing projections 60*q* (flap-portion pressing means) of the pressing members 62 form folding grooves in the cover sheet Sh. Then, when the pressing members 62 approach even more, the spine portion pressing projections (spine pressing members) 60*p* presses and forms the shoulder portion of the cover sheet Sh. (See FIG. 7B.) Because both sides of the cover sheet are pressed firmly by the side portion pressing projections 60*q*, an excess amount of adhesive applied to the spine portion of the inner leaves of the sheet bundle Sn will not leak out to the outside from the folding grooves.

Figure 8A:
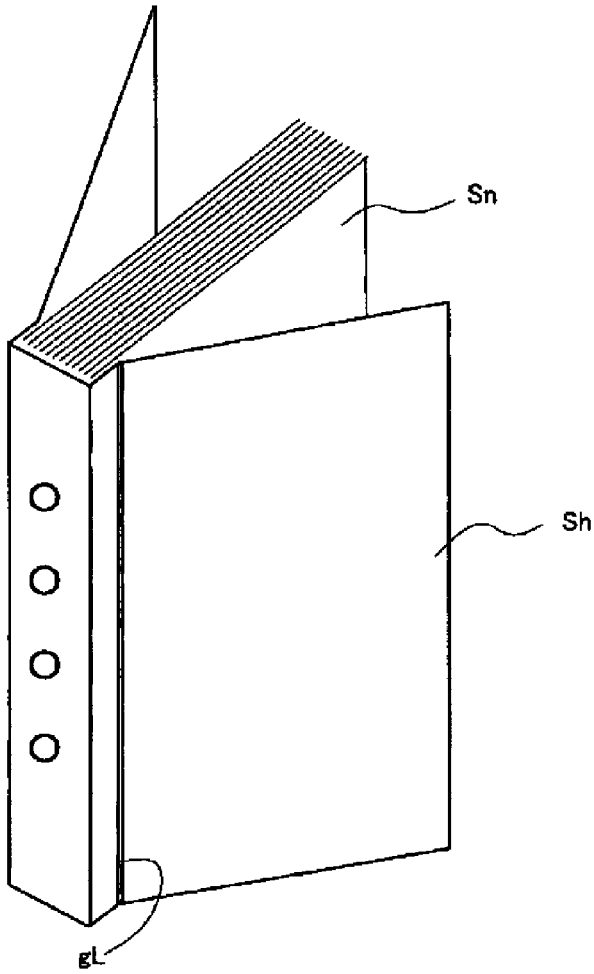
FIGS. 8A and 8B show a sheet bundle formed into a booklet and covered by a cover sheet.
Figure 8B:
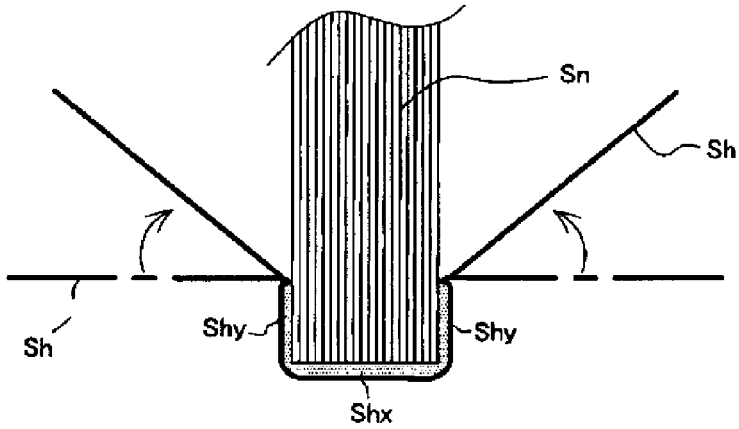

In this way, the folding scores (or folded lines) gL are formed on both sides of the cover sheet Sh as shown FIGS. 8A and 8B, and the cover sheet Sh and inner leaves of the sheet bundle Sn are firmly bound by adhesive at the spine portion Shx and shoulder portion Shy on the inner sides of the cover sheet.

Figure 9:
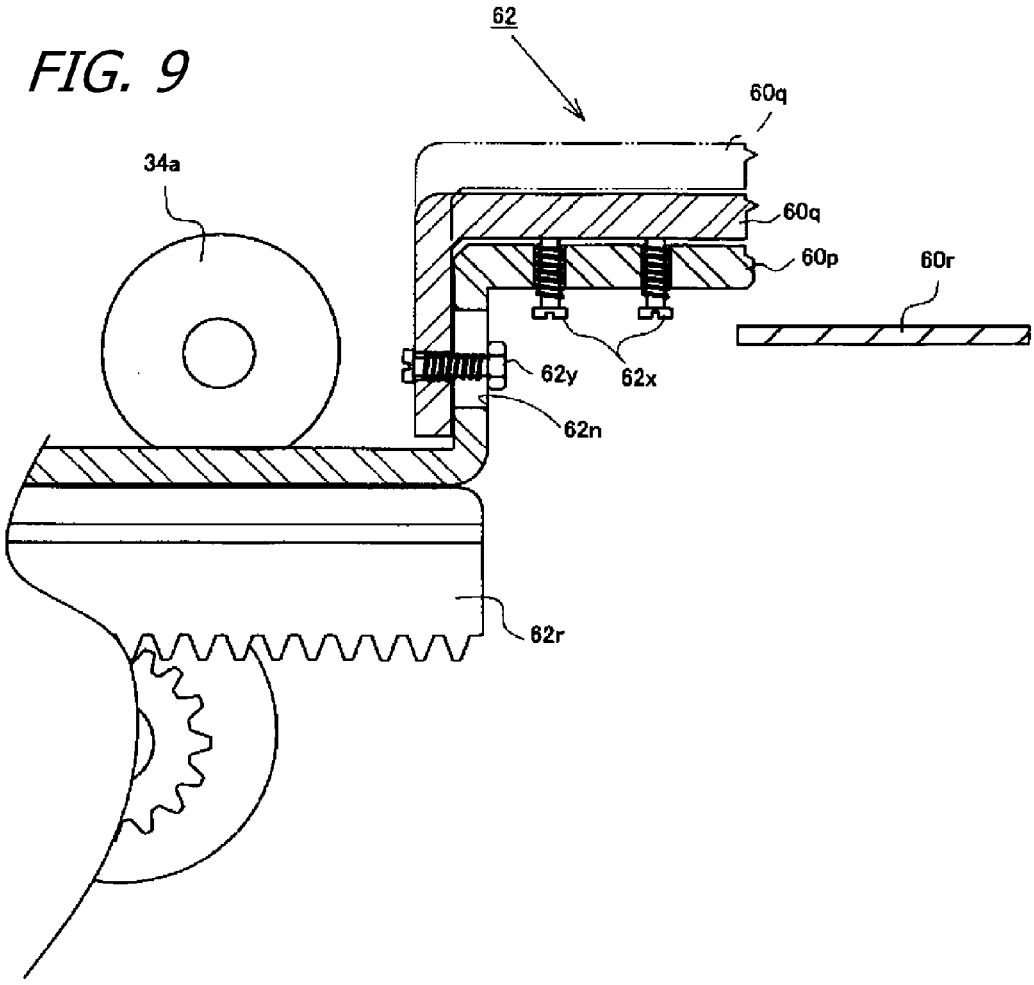
FIG. 9 is an explanatory view of a position adjustment mechanism of the pressing means in the apparatus shown in FIG. 5.

Note that the flap-portion pressing means 60*q* that compose the pressing members 62 can be configured to adjust the positions of the folding grooves that form the cover sheet in up and down directions. As shown in FIG. 9, the pressing members are configured to be separated into the shoulder-portion pressing means 60*p* and the flap-portion pressing means 60*q*. The flap-portion pressing means 60*q* are mounted to the shoulder-portion pressing means 60*p* to be able to freely adjust the height. As shown in the drawing, the flap-portion pressing means 60*q* are fastened to be able to adjust positions in the up and down directions using the height adjustment screws 62*x* and fastening screws 62*y*. This makes it possible to form the folding groove at positions on the cover sheet according to the property of the adhesive used or the thickness of the cover sheet.

Second Embodiment of Cover-Sheet Binding Means (See FIG. 10.) The following will now explain the second embodiment of the cover-sheet binding means 60 shown in FIG. 10. This embodiment is a configuration where the shoulder-portion pressing means and the flap-portion pressing means are separate members. The cover-sheet binding means 60 is disposed in the cover-sheet binding location F as shown in FIG. 10. This cover-sheet binding means 60 is composed of shoulder-portion pressing members 68*a* and 68*b*, and flap-portion pressing members 61*a* and 61*b*. Each of these is disposed in pairs on the left and right sides of the cover-sheet binding location F.

The left and right pair of shoulder-portion pressing members 68*a*, and 68*b* are supported by guide rails, not shown, of the apparatus frame to allow the left and right sides to mutually approach and separate. Also, the flap-portion pressing members 61*a* and 61*b* are matingly supported to slide on the guide rail 61*g* formed on the shoulder-portion pressing members 68*a*, and 68*b*. Micro-motors Mp3 and Mp4 are installed under and supported by these shoulder-portion pressing members 68*a* and 68*b*; eccentric cams 61*w* linked to these micro-motors causes the flap-portion pressing members 61*a* and 61*b* to approach the cover-sheet binding location F. The flap-portion pressing members 61 a and 61 b are urged to eccentric cams 61*w* by return springs, not shown.

On the other hand, rack gears 68L are integrated to the shoulder-portion pressing members 68*a*, 68*b*, and drive pinions 68*p* linked to the control motors Mp1 and Mp2 mesh with these gears. Note that spine portion pressing means 60*r* is disposed in the same way as was described in relation to the first embodiment. Its configuration is also the same as was described. Therefore, an explanation thereof will be omitted.

In this configuration, the shoulder-portion pressing members 68 and the flap-portion pressing members 61 are controlled to (1) press and fold the cover sheet simultaneously, (2) the flap-portion pressing members to form the crease in the sides after the shoulder-portion pressing members fold the cover sheet, or (3) the shoulder-portion pressing members 68 forming a shoulder after the flap-portion pressing members 61 fold the spine of the cover sheet.

Figure 11A:
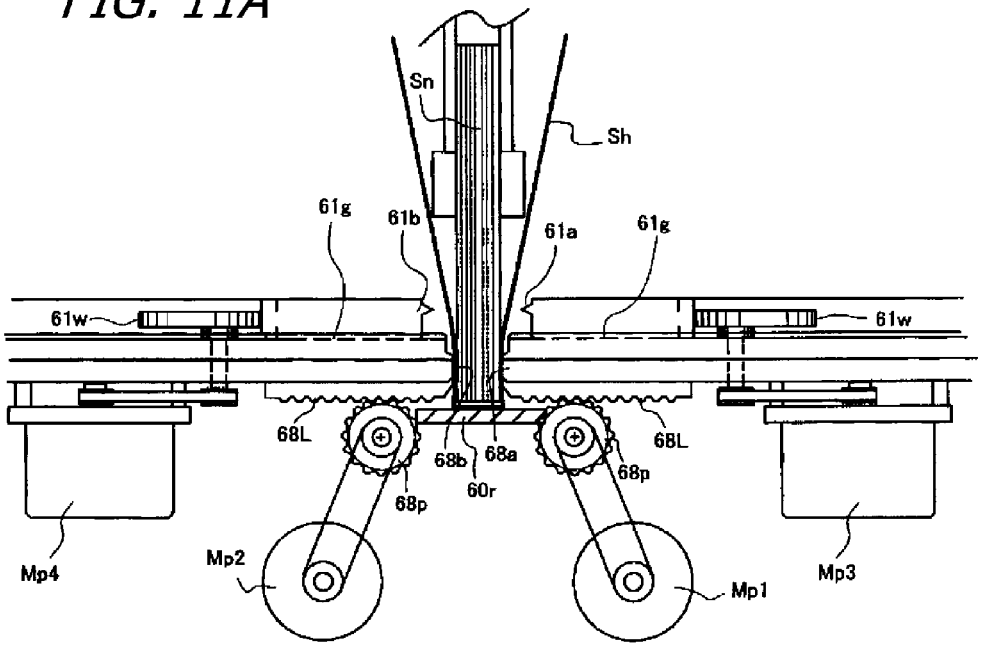
FIGS. 11A and 11B are explanatory views of the operation of the apparatus shown in FIG. 9.
Figure 11B:
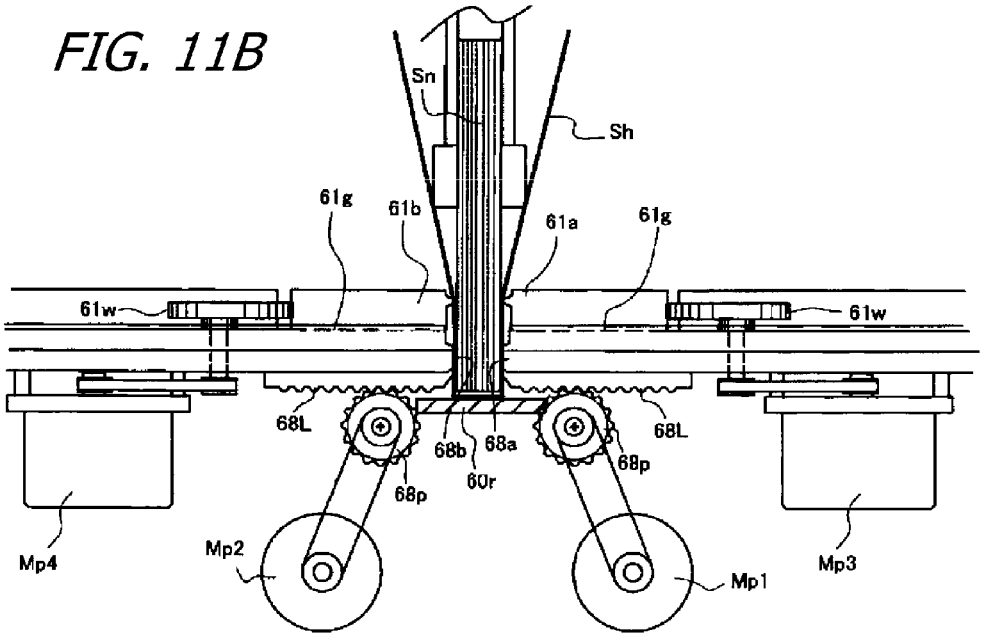

The simultaneous pressing operation is the same as the first embodiment shown in FIG. 5. Therefore, an explanation thereof will be omitted. Also, when the shoulder-portion pressing members 68 are used to crease the cover sheet Sh first, then the flap-portion pressing members 61 are used to form the folding scores (or folded lines) in the cover sheet Sh of (2), the control means (hereinafter referred to as the cover sheet binding control unit 75*c*) touches the inner leaves of the sheet bundle Sn to the cover sheet Sh with the pressing members 68 and 61 positioned at their idle positions, as shown in FIGS. 11A and 11B. This operation is the same as that described in relation to the first embodiment. In the state depicted in FIG. 11A, the cover sheet Sh is folded over the inner leaves of the sheet bundle Sn by the shoulder-portion pressing members 68. For this operation, the control motors Mp1 and Mp2 are rotatingly driven a predetermined amount. The control means rotatingly drives the micro-motors Mp3 and Mp4 mounted on the shoulder-portion pressing members 68*a* and 68*b*. When this happens, the flap-portion pressing members 61*a* and 61*b* create the folded groove in the sides of the cover sheet, as shown in FIG. 11B.

Figure 12A:
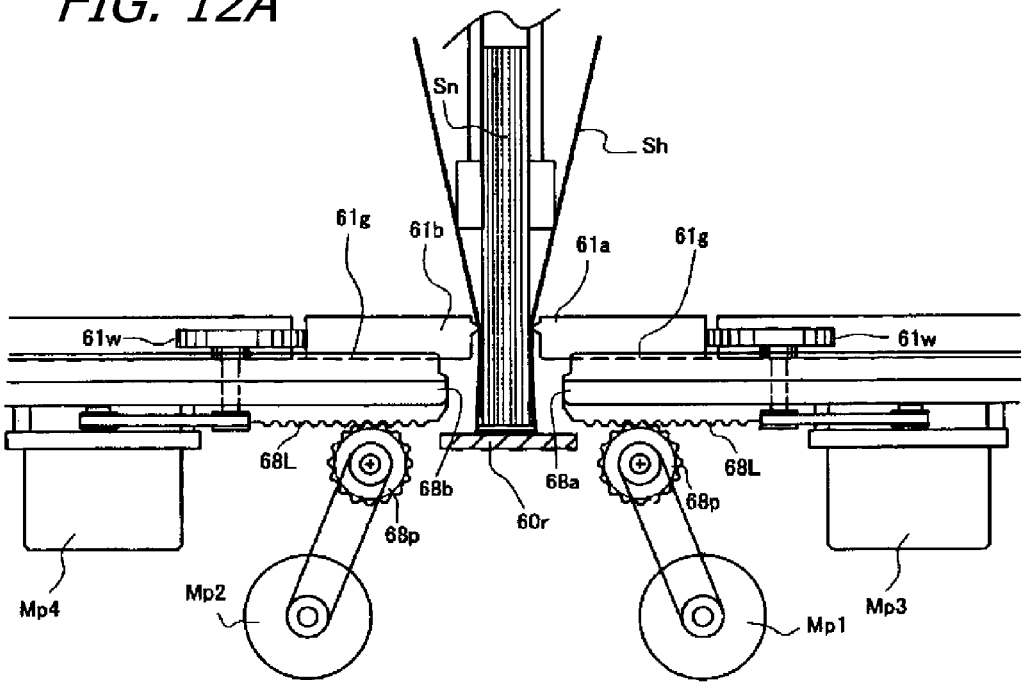
FIGS. 12A and 12B are explanatory views of the operation of the apparatus shown in FIG. 9.
Figure 12B:
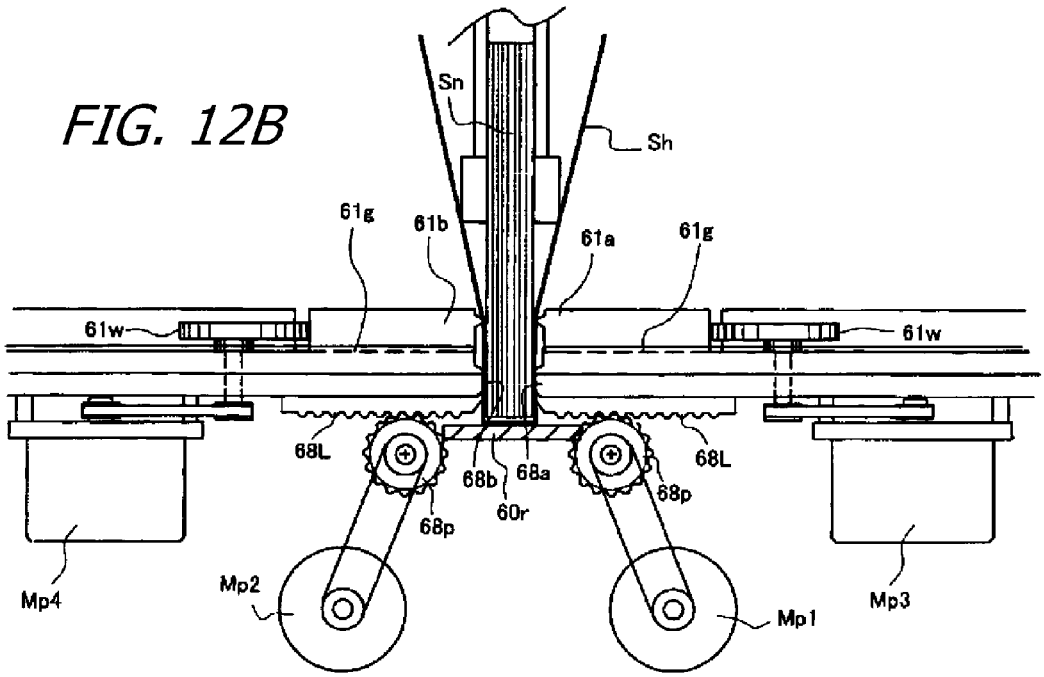

When the flap-portion pressing members 61*a*, 61*b* are used to fold and crease the cover sheet Sh first, then the shoulder-portion pressing members 68*a*, 68*b* are used to press the shoulders of the cover sheet Sh of (3), the cover sheet binding control unit 75*c* touches the inner leaves of the sheet bundle Sn to the cover sheet Sh with the pressing members 68 and 61 positioned at their idle positions, as shown in FIGS. 12A and 12B. This operation is the same as that described in relation to the first embodiment. In the state depicted in FIG. 12A, the cover sheet Sh is folded over the inner leaves of the sheet bundle Sn by the flap-portion pressing members 61*a* and 61*b*. Then the side portions of the cover sheet Sh are creased to form the folded groove. For this operation, the control motors Mp1 and Mp2 are rotatingly driven a predetermined amount and stopped when the shoulder-portion pressing members 68*a* and 68*b* have approached the inner leaves of the sheet bundle Sn. The control means rotatingly drives the micro-motors Mp2 and Mp3 mounted on the shoulder-portion pressing members 68*a* and 68*b*. In the state depicted in FIG. 12A, the cover sheet Sh is folded over the inner leaves of the sheet bundle Sn by the flap-portion pressing members 61*a* and 61*b*. Then, the side portions of the cover sheet Sh are creased to form the folded groove.

The control means rotatingly drives the control motors Mp1 and Mp2 predetermined amounts. This causes the shoulder portions to be pressed and formed by the shoulder-portion pressing members 68*a* and 68*b* while the side portions of the cover sheet Sh are being pressed by the flap-portion pressing members 61*a* and 61*b*, as shown in FIG. 12B. The side portions of the cover sheet Sh at that time are firmly pressed by the flap-portion pressing members 61. By forming the cover sheet in this way, excess adhesive will not leak out to outside of the folded groove when press-forming the shoulders of the cover sheet Sh.

Folding rollers 63 are disposed downstream of the cover-sheet binding means 60 described above. These folding rollers comprise a pair of rollers that pressure-nip the sheet bundle formed with the cover sheet to provide a finish to the booklet.

Configuration of Bundle-Posture Changing Means and Trimming Means

Figure 4:
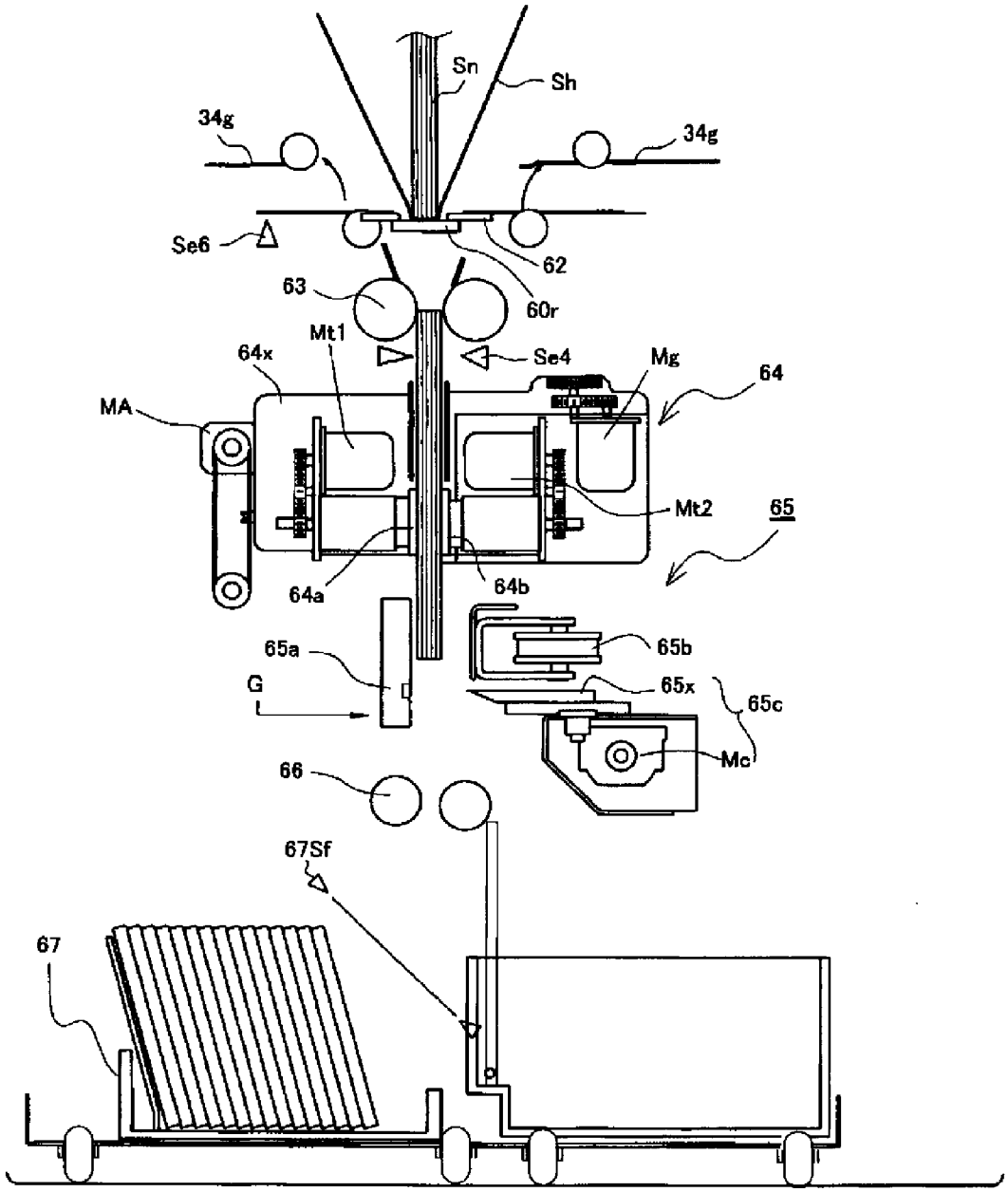
FIG. 4 is an explanatory drawing of a configuration of a bundle posture changing means in the apparatus shown in FIG. 2.

A bundle-posture changing means 64 that turns the sheet bundle over from top to bottom, and trimming means 65 that cuts the edges of the sheet bundle are disposed in the trimming position G positioned downstream of the folding rollers 63. The bundle-posture changing means 64 turns the covered sheet bundle fed from the cover-sheet binding location F to a predetermined direction (or posture) and conveys the sheet bundle downstream to the trimming means 65 or the storage stacker 67. The trimming means 65 trims the fringes of the sheet bundle to align the edges. Therefore, the bundle-posture changing means 64 is equipped with rotating tables 64*a*, 64*b* that grip and turn the sheet bundle fed from the folding rollers 63. As shown in FIG. 4, the rotating tables 64*a*, 64*b* are established on the unit frame 64*x* installed on the apparatus frame to rise and lower. The pair or rotating tables 64*a*, 64*b* that sandwich the bookbinding path 33 are rotatably supported on bearings in the unit frame 64*x*; one of the movable rotating tables 64*b* supported to move in a sheet bundle thickness direction (a direction orthogonal to the bookbinding path 33). Spinning motors Mt1, Mt2 are furnished in the bookbinding path 33 for the rotating tables 64*a*, 64*b* to change the posture of the sheet bundle. A grip motor Mg is provided for the movable side rotating table 64*b* to move in the left and right directions of FIG. 4.

Therefore, the sheet bundle guided to the bookbinding path 33 is gripped by the pair of left and right rotating tables 64*a*, 64*b*, then the posture of the sheet bundle is changed by the turning motors Mt1, Mt2. For example, the sheet bundle with its spine portion conveyed downward is rotated 180 degrees and fed to downstream discharge rollers 66 with the fore-edge portion facing downward. The sheet bundle is sequentially rotated 90 degrees to turn the sheet bundle's top and bottom and front end portion at a downstream trimming position G to enable the trimming of three edge directions of the sheet bundle. Note that a grip sensor (not shown) is provided on the rotating table 64*b* of the movable side. This detects that the sheet bundle has been securely gripped between the left and right side rotating tables 64*a*, 64*b*. After detection, the rotating tables 64*a*, 64*b* are configured to revolvingly drive. Also, the unit frame 64*x* raises and lowers the sheet bundle along the bookbinding path 33 using an elevator motor MA. This is to configure a jog mechanism to offset a predetermined amount the sheet bundle fed by the discharge rollers 66 and convey the sheet bundle to a trimming position G when trimming edges of the sheet bundle, and to set the trimming width at the trimming position G by that feed amount.

Configuration of Trimming Means

Trimming means 65 are provided downstream of the bundle posture changing means 64. As shown in FIG. 4, the trimming means 65 is composed of trimming edge pressing member 65*b* that pressingly supports the trimming edge of the sheet bundle to a blade-edge bearing member 65*a* and a trimming blade unit 65*c*. The trimming edge pressing member 65*b* is disposed in a position that opposes the blade-edge bearing member 65*a* disposed in the bookbinding path 33, and is composed of a pressing member that moves in an orthogonal direction to the sheet bundle by drive means, not shown. The trimming blade unit 65*c* is composed of a flat, blade-shaped trimming blade 65*x* and a cutter motor MC that drives that blade. The trimming means 65 with this configuration cuts a predetermined amount around the edges, excluding the spine of the sheet bundle that has been made into a booklet, to align the edges.

A discharge roller (discharge means) 66 and storage stacker 67 are disposed downstream of the trimming position G. This storage stacker 67 stores sheet bundles in an inverted manner as shown in FIG. 2. This storage stacker 67 is disposed to be drawn from the casing 30 as shown in FIG. 1. The stacker can be drawing toward the front side of the apparatus (the front side of FIG. 1)The operator can view it from the top directions when it is drawn to the front of the apparatus. Note that 67Sf in the drawing denotes a full detection sensor. This detects when the storage stacker 67 is at full capacity with sheet bundles stacked therein and issues a warning to the operator to remove the sheet bundles.

Finishing Unit Configuration

The finishing unit C is arranged in the bookbinding unit B. The finishing path 38 is equipped to be connected to cover sheet conveyance path 34 for the finishing unit C and a finisher, such as a staple unit, punch unit, and stamp unit or the like, is disposed in the finishing path 38. Printed sheets are received from the image-forming apparatus A via the cover sheet conveyance path 34 and stapled, punched or applied with a mark, then conveyed to the discharge tray 37. It is also possible not to apply any finishing process on printed sheets and to store them in the discharge tray 37 directly from the image-forming apparatus A.

Configuration of Control Means

Figure 13:
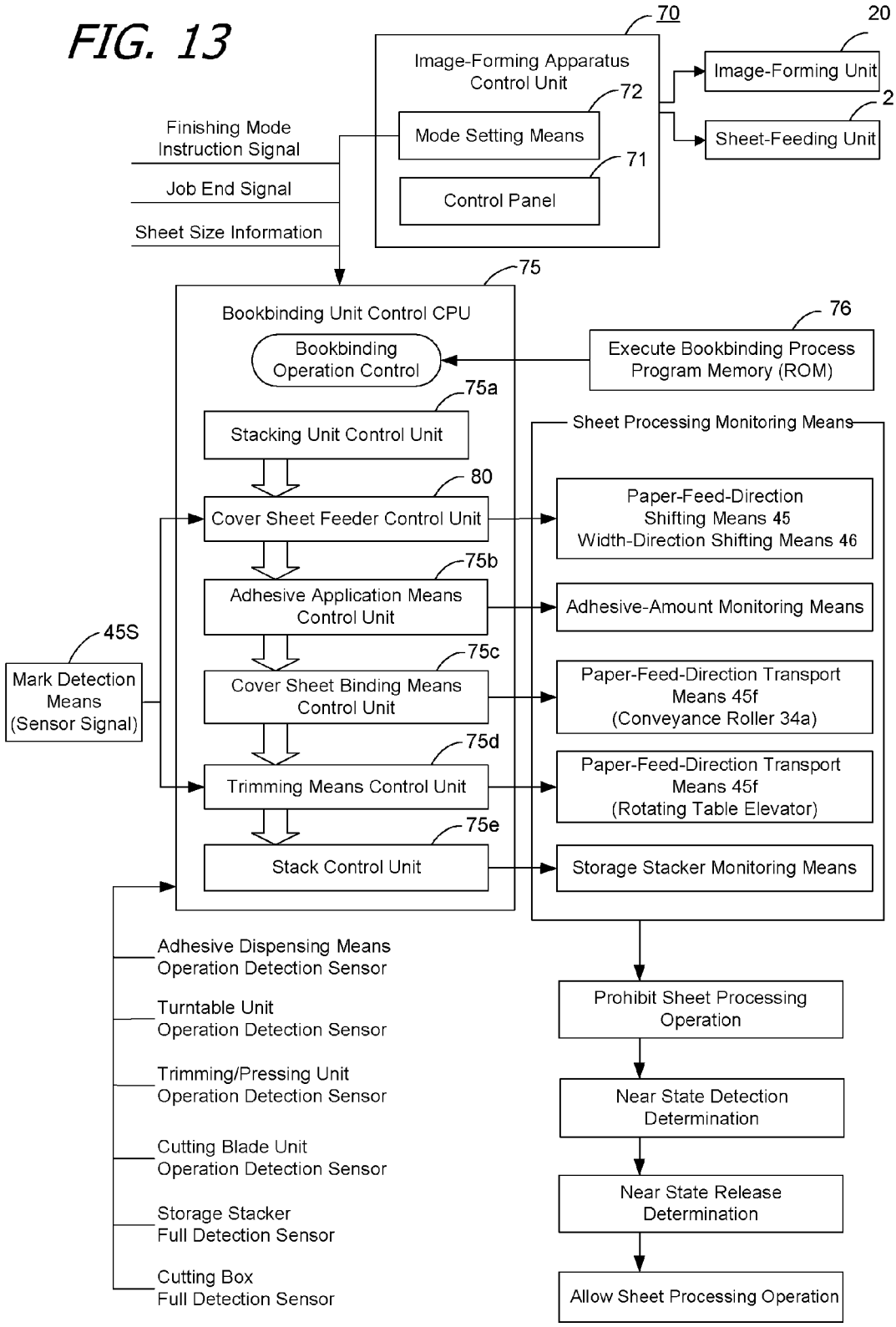
FIG. 13 is a block schematic view of a configuration of control means in the apparatus shown in FIG. 2.

The configuration of the control means in the apparatus described above will now be explained with reference to FIG. 13. FIG. 6 is a block diagram to assist in describing the control means. As shown in FIG. 1, in the system that connects the image forming apparatus A and the bookmaking apparatus B, a control panel 71 and mode selection means 72 are furnished on the control CPU70 equipped on the image forming apparatus A. A control CPU75 is equipped in the control unit of the bookbinding unit B. This control CPU75 calls up a bookbinding execution program from the ROM76 and executes each process in the bookbinding path 33.

This control CPU75 receives a finishing mode instruction signal, job end signal, sheet size information, and other information and command signals required in the bookbinding process from the control CPU70 of the image-forming unit A. On the other hand, sheet sensors Se1 to Se6 are arranged in the positions shown in FIG. 1 to detect the sheets (sheet bundle) conveyed to the conveyance path 31, bookbinding path 33, and cover sheet conveyance path 34. Detection signals from the sheet sensors Se1 to Se6 are transmitted to the control CPU75; the control CPU75 is equipped with "stacking unit control unit 75*a*"; "adhesive application means control unit 75*b*"; "cover-sheet binding means control unit 75*c*"; "trimming means control unit 75*d*"; "stack control unit 75*e*"; and "adhesive temperature control unit 79." The bookbinding process is executed according to the flowchart shown in FIG. 14.

Explanation of Bookbinding Operation

Next, the bookbinding process operations using the control CPU75 will now be explained with reference to the flowchart block diagram of FIG. 14. Image forming conditions and a finishing mode are set (St001) using the control panel 71 on the image-forming apparatus A. "Print-out mode," "bookbinding mode," "staple mode," "marking mode," "hole-punching mode," and "jog mode" can be set as the finishing mode, for example. In the print-out mode, a sheet formed with an image is not formed into a booklet or finished. It is conveyed out to the discharge tray 37 (equipped on the finisher in the drawings) and stored.

With the bookbinding mode, sheets formed images are aligned and stacked, then joined with a cover sheet and stored in the storage stacker 67. Also, in the staple mode, sheets formed with images are stapled by a stapling unit equipped in the finishing unit C; in the marking mode, a mark is applied; in the hole-punching mode, holes are punched in the sheets; and in the jog mode, sheets are sorted. Each of these modes is executed by the finishing unit C, and then the finished sheets are stored in the discharge tray 37.

When the bookbinding mode is selected and the finishing mode, an image forming operation is executed by the image-forming unit A, and the sheet formed with images is conveyed out from the discharge outlet 14. (St002) With the bookbinding unit C, this sheet is received in the conveyance path 31. At this time the CPU75 positions the path switching flapper 36 in the state shown in FIG. 2 to guide the sheet to the intermediate sheet conveyance path 32. The sheet is fed to the discharge outlet 32*b* by the conveyance rollers 32*a* and sequentially stacked and stored in the stacker 41 (St003).

There, when the job end signal (St004) is received from the image-forming unit A, the control CPU75 conveys the sheet bundle on the stacking tray 41 by the gripping conveyance means 47 to turn the sheet bundle posture 90 degrees. This changes the posture of the sheet bundle collated on the stacking tray 41 from a horizontal orientation to a vertical orientation to be conveyed over the bookbinding path 33 to the downstream adhesive application position E (St005).

The control CPU75 conveys a cover sheet from the cover sheet conveyance path 34 at the time the sheet bundle is conveyed to and set at the adhesive application position E (St006). This cover sheet can be fed after being formed with an image at the image-forming unit A, or fed from the inserter unit 26. When supplying a cover sheet from the inserter unit 26, the control CPU75 activates feeding means, not shown, to convey one sheet at a time from the tray 26*a* to the sheet feeding path 27.

After the conveyance and setting of the cover sheet at the binding position, the control CPU75 drives the adhesive application means 55 to apply adhesive to the sheet bundle set at the adhesive application position E (St007). The adhesive container 56 equipped with the applicator roller 57 moves along the bottom edge S1 of the sheet bundle (the direction to the right in FIG. 3B) to apply adhesive coated on the roller surface onto the sheet bundle.

After finishing the adhesive application operation, the control CPU75 conveys the sheet bundle to the downstream cover-sheet binding location F using the gripping conveyance means 47. When this happens, the cover sheet is set at that position so the cover sheet is backed up by the spine support plate 61 and joined to the sheet bundle in an upside-down T-shape. Next, the sheet bundle covered by the folding plates 62 press-forming the backside of the cover sheet.

After the covering process above, the control CPU75 determines whether a trimming mode has been selected (St009). For the trimming mode, the gripping conveyance means 47 releases from the sheet bundle and returns to its default position. A trimming blade 65*x* is positioned at the trimming position G and stops the descending sheet bundle (St010). In this state, the movable rotating table 64*b* moves from the idle position to a sheet gripping position to nip-retain the sheet bundle between itself and the rotating table 64*a* (St011). Next, after the control CPU75 moves the trimming blade 65*x* to the idle position, it revolves the rotating tables 64*a*, 64*b* 90° to turn the sheet bundle so that its top is at the bottom side (St012).

After the covered sheet bundle is turned to a predetermined posture, the control CPU75 drives the elevator motor MA of the bundle posture changing means 64 to set the covered sheet bundle at the trimming position G. (St013) This feeding and setting convey the covered sheet bundle gripped by the rotating tables 64*a*, 64*b* downstream by activation of the elevator motor MA.

There, the trimming edge pressing member 65*b* pressingly holds the sheet bundle and the trimming blade 65*x* cuts a predetermined amount (St014). Next, the control CPU75 retracts the trimming edge pressing member 65*b* to the idle position, then turns the covered sheet bundle 180 degrees so that the other side is at the bottom to trim the bottom portion. Next, the control CPU75 retracts the trimming edge pressing member 65*b* to the idle position, then turns the sheet bundle 90 degrees so that the other side is at the bottom to cut the bottom portion. After the sides of the sheet bundle are cut and aligned in this way, the control CPU75 ends trimming the three directions of the sheet bundle and shifts to the discharge operation (St015).

On the other hand, at step St009 above, if there is no trimming mode selected, the control means 75 shift to the next discharge operation. At the discharge operation, the control CPU75 activates the discharge roller 66 to store the sheet bundle in the stacker 67.

What is claimed is:

1. A bookbinding unit comprising:

stacking tray means for collating into bundles sequentially fed sheets;

a bookbinding process path for sequentially transporting sheet bundles from said stacking tray means into an adhesive-application location and a cover-sheet binding location;

adhesive application means, disposed in the adhesive-application location, for applying adhesive to sheet bundles from said stacking tray means;

cover-sheet supply means for supplying cover sheets to the cover-sheet binding location; and cover-sheet binding means, disposed in the cover-sheet binding location, for binding sheet bundles from said adhesive-application means together with cover sheets; wherein said cover-sheet binding means has shoulder-portion pressing means with pressing faces for forming spine creases in shoulder portions extending into spine portions of the cover sheets, flap-portion pressing means for forming folding scores in the spine-creased flaps of the cover sheets, spaced apart from the cover-sheet shoulders, and recesses provided between said shoulder-portion pressing means and said flap-portion pressing means, said recesses being sunken in, with respect to the cover sheets, from said pressing faces of said shoulder- portion pressing means; and the shoulder-portion pressing means and the flap-portion pressing means are configured to selectively either shift unitarily to press-form the cover sheets, or shift individually to press-form the cover sheets.

2. The bookbinding unit according to claim 1 wherein pressing pressures of said shoulder-portion pressing means and said flap-portion pressing means are preestablished so that, when spine creases are formed in a cover sheet with said shoulder-portion pressing means, adhesive leaking onto the cover-sheet shoulders is controlled with said flap-portion pressing means to form predetermined flap glue portions.

3. The bookbinding unit according to claim 1 wherein:

said shoulder-portion pressing means and said flap-portion pressing means are constituted by identical pressing members;

said pressing members have shoulder-portion forming units for spine-creasing the cover sheets, and flap-portion forming units for forming the folding scores in the flap portions of the cover sheets; and said shoulder-portion forming units are configured to forcibly press the shoulders of a cover-sheet in the state in which folding scores have been formed therein by said flap-portion forming units.

4. The bookbinding unit according to claim 2 wherein:

said shoulder-portion pressing means and said flap-portion pressing means are constituted by identical pressing members;

said pressing members have shoulder-portion forming units for spine-creasing the cover sheets, and flap-portion forming units for forming the folding scores in the flap portions of the cover sheets; and said shoulder-portion forming units are configured to forcibly press the shoulders of a cover-sheet in the state in which folds have been formed therein by said flap-portion forming units.

5. The bookbinding unit according to claim 1, wherein said shoulder-portion pressing means and said flap-portion pressing means are constituted by respective pairs of shoulder-portion pressing members and flap-portion pressing members; the bookbinding unit therein being configured so that (1) said shoulder-portion pressing members and said flap-portion pressing members simultaneously spine-crease press the cover sheets;

(2) after said shoulder-portion pressing members have formed spine-creases in a cover sheet, said flap-portion pressing members form the folding scores in the cover's flaps; or (3) after said flap-portion pressing members have spine-creased a cover sheet, said shoulder-portion pressing members mold the cover-sheet's shoulders.

6. The bookbinding unit according to claim 2, wherein said shoulder-portion pressing means and said flap-portion pressing means are constituted by respective pairs of shoulder-portion pressing members and flap-portion pressing members; the bookbinding unit therein being configured so that (1) said shoulder-portion pressing members and said flap-portion pressing members simultaneously spine-crease press the cover sheets;

(2) after said shoulder-portion pressing members have formed spine-creases in a cover sheet, said flap-portion pressing members form the folding scores in the cover's flaps; or (3) after said flap-portion pressing members have spine-creased a cover sheet, said shoulder-portion pressing members mold the cover-sheet's shoulders.

7. The bookbinding unit according to claim 5, wherein said flap-portion pressing members are configured to enable adjusting the positions where the folding scores are formed in the spine-creased flap portions of the cover sheets.

8. The bookbinding unit according to claim 6, wherein said flap-portion pressing members are configured to enable adjusting the positions where the folding scores are formed in the spine-creased flap portions of the cover sheets.

9. The bookbinding unit according to claim 1, wherein:

gripping conveyance means are provided in said bookbinding process path for conveying sheet bundles from said stacking tray means to the cover-sheet binding location; and a sheet bundle gripped in the cover-sheet binding location by said gripping conveyance means is bound together with a cover sheet by said cover-sheet binding means.

10. The bookbinding unit according to claim 2, wherein:

gripping conveyance means are provided in said bookbinding process path for conveying sheet bundles from said stacking tray means to the cover-sheet binding location; and a sheet bundle gripped in the cover-sheet binding location by said gripping conveyance means is bound together with a cover sheet by said cover-sheet binding means.

11. The bookbinding unit according to claim 1, wherein:

said cover-sheet binding means comprises said shoulder-portion pressing means and said flap-portion pressing means, and is further furnished with spine rest/pressing means for abutting on and supporting the spine-covering portion of a cover sheet; and said spine rest/pressing means situates and supports cover sheets supplied to the cover-sheet binding location; the bookbinding unit therein being configured so that after a cover sheet supported on said spine rest/pressing means has been spine-creased by said shoulder-portion pressing means, the folding scores are formed in the cover by said flap-portion pressing means.

12. The bookbinding unit according to claim 2, wherein:

said cover-sheet binding means comprises said shoulder-portion pressing means and said flap-portion pressing means, and is further furnished with spine rest/pressing means for abutting on and supporting the spine-covering portion of a cover sheet; and said spine rest/pressing means situates and supports cover sheets supplied to the cover-sheet binding location; the bookbinding unit therein being configured so that after a cover sheet supported on said spine rest/pressing means has been spine-creased by said shoulder-portion pressing means, the folding scores are formed in the cover by said flap-portion pressing means.

13. An image-forming system comprising:

an imaging apparatus for sequentially forming images onto sheets; and a bookbinding unit for collating into bundles sheets from said imaging apparatus and binding the bundles together with cover sheets; wherein said bookbinding unit is configured as set forth in claim 1.

14. An image-forming system comprising:

an imaging apparatus for sequentially forming images onto sheets; and a bookbinding unit for collating into bundles sheets from said imaging apparatus and binding the bundles together with cover sheets; wherein said bookbinding unit is configured as set forth in claim 2.

15. The bookbinding unit according to claim 1, wherein said flap-portion pressing means is configured so as to protrude thickness-wise, with respect to a sheet bundle therein, more than said shoulder-portion pressing means, to form the folding scores in the spine-creased flaps, spaced apart from the cover-sheet shoulders.

16. The bookbinding unit according to claim 1, wherein said shoulder-portion pressing means is provided on a lower edge of said cover-sheet binding means, and said flap-portion pressing means is provided on an upper edge of said cover-sheet binding means.

17. The bookbinding unit according to claim 1, wherein said shoulder-portion pressing means is formed as flat-faced projections, and said flap-portion pressing means is formed as sharp projections.

* * * * *